US005528504A

United States Patent [19]

Brewer

[11] Patent Number: 5,528,504

[45] Date of Patent: Jun. 18, 1996

[54] EQUIVALENT THICKNESS BENDING ANALOGY FOR INTEGRALLY STIFFENED STRUCTURES

[75] Inventor: Harold M. Brewer, Goodlettsville, Tenn.

[73] Assignee: Avco Corporation, Providence, R.I.

[21] Appl. No.: 293,813

[22] Filed: Aug. 22, 1994

[51] Int. Cl.[6] ..... G06F 19/00

[52] U.S. Cl. ..... 364/468; 364/474.07; 364/476; 72/702

[58] Field of Search ..... 364/474.07, 472, 364/468, 476, 477; 29/DIG. 2, DIG. 3; 72/702; 148/500–502, 695

[56] References Cited

U.S. PATENT DOCUMENTS

| | | | |
|---|---|---|---|
| 4,819,467 | 4/1989 | Graf et al. | 72/702 |
| 4,989,439 | 2/1991 | Ewert et al. | 72/702 |
| 5,168,169 | 12/1992 | Brewer, Jr. et al. | 364/474.07 |

OTHER PUBLICATIONS

"Age Forming Integrally Stiffened, Aluminum Aerospace Structures in an Autoclave", Brewer, H., (AIAA 89–2087), AIAA/AHS/ASEE Aircraft Design, Systems and Operations Confrence, Seattle, WA, Jul. 31–Aug. 2, 1989, pp. 1–12.

"Autoclave Age Forming Large Aluminum Aircraft Panels", Holman, Mitchell C., Journel of Mechanical Working Technology, 20 (1989) 477–488, Elsevier Science Publishers B. V., Amsterdam.

"Age Forming Technology Expanded in an Autoclave", Hambrick, D. M., Society of Automotive Engineers, Inc., 1986 pp. 4.649–4.663.

"Metallurgy of Heat Treatment and General Principals of Precipitation Hardening", Ch. 5 Aluminum–Properties and Physical Metallurgy, Ed. Hatch, J. E., American Society for Metals, Metals Park, Ohio, 1984, title page, copyright page, table of contents (2 pages), pp. 134–139 and 177–193.

"Age Forming Aluminum in An Autoclave", H. Brewer, Jr. and M. Holman, World Aerospace Technology 1990 Publications International Limited, London, 1990 cover, pp. 3, 7, 11, and 41–46.

Miller, A. K., and Sherby, O. D., "A Simplified Phenomenological Model for Non–Elastic Deformation: Prediction of Pure Aluminum Behavior and Incorporation of Solute Strengthening Effects," Acta Metallurgica, vol. 26, 1978, pp. 289–304.

Metals Abstracts, vol. 25, No. 4, Apr. 1992, London GB, p. 197, S. Foroudastan et al., Abstract No. 52–0659, "Application of a Unified Viscoplastic Model of Residual Stress to the Simulation of Autoclave Age Forming".

*Primary Examiner*—Paul Gordon
*Assistant Examiner*—Steven R. Garland
*Attorney, Agent, or Firm*—Perman & Green

[57] ABSTRACT

A method is disclosed for developing the contour of tools employed for forming members exhibiting complex shapes. The members may be precipitation, heat treatable, metals or metal alloys which are age formed, although they be of any material which exhibits a relationship between a strain applied by a forming tool, or otherwise, and a resulting strain after release of the applied strain. The resulting member may be formed to the desired contour as a result of exposure to an elevated temperature but the member may also be cold formed. The invention is particularly concerned with a methodology for simplifying the analysis of integrally stiffened structures of complex shape. The method of the invention assures proper results on the first occasion the tool is used, thereby resulting in considerable savings of labor and material.

29 Claims, 14 Drawing Sheets

EQUIVALENT THICKNESS BENDING ANALOGY FOR INTEGRALLY STIFFENED STRUCTURES

BACKGROUND OF THE INVENTION

1. Field of the Invention

The present invention relates generally to a method of developing the contours of forming tools for members exhibiting complex shapes. The techniques of the present invention represent an improvement over those disclosed in commonly assigned U.S. patents, namely, U.S. Pat. No. 5,168,169 of H. Brewer and M. Holman entitled "Method of Tool Development" and U.S. Pat. No. 5,341,303 of S. Foroudastan and M. Holman entitled "Method of Developing Complex Tool Shapes". In this specific instance, the invention is directed to a methodology for simplifying the analysis of integrally stiffened structures of complex shape. While the instant disclosure refers to application of the technique of the invention on aluminum alloy material and also utilizes the principles of age forming for forming the member being fabricated, the invention need not be so limited. Indeed, the technique of the invention can be applied to any material for which there is a relationship between a strain in a member applied by a forming operation and a resulting strain in the member after the applied strain has been released. Thus, the invention can be applied to both cold forming and hot forming operations.

2. Description of the Prior Art

The complex shapes of the contoured members that make up aerospace structures are inherently difficult to form. Due to the shapes required by aerodynamics and because of the emphasis on load carrying capability combined with weight efficiency, optimized designs are created that require complex contours to be produced in high strength metals. Examples of such contoured members would include wing skin panels, fuselage panels, and structural stiffening elements such as spars and stringers for aircraft applications; as well as the shroud, skirt, and tankage members of space launch vehicles. Such members are characterized by extreme metal thickness variations and integrally machined features. The criticality of design requires precise forming tolerances be maintained without sacrificing the fatigue life, reliability, or strength of the member as a result of the forming process chosen.

Conventional forming methods, such as roll forming, brake forming, stretch forming, and peening, are cold working processes that achieve permanent deformations through the application of mechanical bending and/or stretching. Achieving uniform forming across integrally machined features or abrupt changes in thickness may not be possible without specialized tooling or extensive modifications to the forming equipment. In some cases, it may not be possible to develop the deformation forces necessary to accommodate extreme material thicknesses.

While various machines can handle a wide range of metal thicknesses, it is not practical to form metals varying from one extreme of the thickness range to the other, since most machines must be set up prior to operating. From this standpoint, skin tapers and recesses that occur within a panel may not be formable. Forming applications that have openings or cutouts machined into them may not be formable without distorting the opening or leaving flat spots in the contour. Other processes are limited by the size of the forming machinery and those applications that will fit within the working envelope. Custom equipment for larger or smaller applications can be prohibitively costly and inflexible.

In addition to the physical limitations imposed by part geometry are characteristic traits that result from the forming process used. Traits such as strain hardening, residual stresses, and marking accompany many of the forming processes commonly employed. In some cases these effects can produce desirable qualities, such as stress corrosion cracking resistance. Likewise others can produce undesirable qualities, such as a negative effect on the fatigue life and reliability of the formed part. The point to be made is that each forming process must be carefully matched to the intended application.

All of the conventional forming processes mentioned have one important disadvantage in common: each requires the expertise of a skilled operator. With the exception of some processes which have been automated to an extent, considerable operator skill is required to obtain tight tolerances; therefore, process consistency is low. Part to part variations in contour can result in engineering specified contour rework being required on every unit produced. Contour variations that do not require post forming corrections can still cause fit-up problems at assembly. Contour variations from part to part create numerous manufacturing difficulties, each with costly solutions.

While conventional cold forming processes have their drawbacks, they also have significant advantages for certain applications and tend to be much more economical than other known processes. It is noteworthy that the present invention can be applied to cold forming processes whenever it is practical to do so.

In the recent past, a significant advancement of known techniques for forming complex members while maintaining or even improving upon their inherent strength characteristics has been devised. Known as age forming, it is a process that offers many solutions to the problems encountered when conventional cold forming processes are applied to complex shaped contoured members. During age forming, a part is restrained to a predetermined tooling contour and precipitation aged. Age forming is a thermal forming process that utilizes the phenomenon of metallurgical stress relaxation during precipitation heat treatment for the purpose of converting elastic strain to a plastic state.

The age forming process may be performed on any of the precipitation heat treatable metals and metal alloys such as aluminum alloys in the 2xxx, 6xxx, 7xxx, and 8xxx series.

Age forming may be performed according to standard heat treatment cycles utilized in precipitation hardening of alloys. The underlying principles of precipitation heat treating are explained in "Aluminum Properties and Physical Metallurgy", Edited by John E. Hatch, *American Society for Metals,* Metals Park, Ohio, 1984, pp. 134–138 and 177–188, which is incorporated herein in its entirety by reference. As a result, suitable applications require the final condition of the formed components to be in an artificially aged temper. Every end use of a structure must be reviewed in light of the property changes that occur as a result of artificial aging. In some cases, the mechanical properties associated with an artificially aged temper may not be suitable for an intended application. As an example, aluminum alloy 2024 loses fracture toughness as it is artificially aged from the T3 to the T8 temper. This change presents a barrier to age forming applications where fracture toughness is a key design element, such as lower wing skins and fuselage panels for aircraft. Material and/or design changes are required in these cases to allow for the utilization of age forming. In other cases, age forming allows the added benefit of being able to produce contours in a strengthened temper, without developing high levels of residual stress within the component. An example of this feature is provided when aluminum alloy 7150 is age formed from the soft W temper to the hardened T6 temper.

More recently, the conventional age forming process has been modified and substantially improved through the use of the autoclave. The autoclave is a computer controlled pressure vessel, with the added benefit of being a certifiable source for heat treating aluminum. Age forming has traditionally been performed in a furnace, where a mechanical means of constraining the part to the predetermined forming shape is required. The autoclave offers the advantage of using vacuum and internal pressure to obtain the desired contour. Since pressure acts uniformly about the surface of the part, integrally machined features receive the same deformation force as the rest of the panel. Another important advantage is that the forming pressure is distributed about the entire surface area of the part. Therefore, a small differential pressure can equate to many tons of applied force when acting over a large surface. Most conventional processes concentrate the forming forces over a small area, thereby restricting the total available deformation force.

The autoclave is computer controlled allowing high levels of process consistency and accuracy. Computer control allows the process to be operator independent. A separate computerized system closely monitors and records the pressure and temperature within the autoclave providing traceability and process verification. These two features inherently endow autoclave age forming with high levels of process consistency and accuracy. Each panel receives the same processing; consequently, repeatability is ensured. It is this feature that makes the process adjustable. The tooling contour is "fine tuned" until the desired results are obtained.

Tooling for the autoclave is designed according to the springback anticipated for the application. Springback refers to the tendency for a member being formed to return to some shape intermediate its original shape and that of the tool to which it is subjected during heat treatment.

This phenomenon will be discussed at length below. Forming tools are designed with removable contour boards and other features that allow for rapid contour modifications. Unlike other forming processes, age forming does not typically allow for multiple forming iterations to be performed upon the same piece. Age forming is a heat treatment process; therefore, running a part more than once could result in over aging the material. Until the tooling contour is finalized, contour corrections must be performed by another forming process. Once the final tool contour is reached, secondary corrective forming processes are not necessary.

This inability to repeat the heat treatment process on a member being fabricated requires that it be scrapped if it exhibits an incorrect final contour and the procedure repeated with a new member. The cost of labor and materials for such necessarily repeated iterations of the process have led to the methods of the present invention.

SUMMARY OF THE INVENTION

A method is disclosed for developing the contour of tools employed for forming members exhibiting complex shapes. The members may be precipitation, heat treatable, metals or metal alloys which are age formed, although they be of any material which exhibits a relationship between a strain applied by a forming tool, or otherwise, and a resulting strain after release of the applied strain. The resulting member may be formed to the desired contour as a result of exposure to an elevated temperature but the member may also be cold formed. The invention is particularly concerned with a methodology for simplifying the analysis of integrally stiffened structures of complex shape. The method of the invention assures proper results on the first occasion the tool is used, thereby resulting in considerable savings of labor and material. The method of the present invention is an improvement on those techniques disclosed in commonly assigned U.S. Pat. Nos. 5,168,169 and 5,341,303.

Calculating the retained strain as represented by a complex shaped specimen in the formed condition is a key requirement in U.S. Pat. No. 5,168,169. This is a difficult task and is only disclosed in the patent for specimens of constant thickness. In the present invention, it is not necessary to calculate the retained strain as represented by the complex specimen in the formed condition. This represents a significant departure from the aforesaid patent. It also represents a key simplification. In the present invention, the effects upon the forming process of specimen geometry (that is, configuration) are isolated from those due to material.

The invention makes use of the concepts of the original patent, but is not a logical extension of its teachings. The original patent is totally concerned with the interrelationship of applied and retained strain as they relate to the specific specimen configuration under examination. The new invention does not rely upon the applied strain relationship or the need to calculate it, but instead isolates and relates the effects due to specimen geometry alone as defined by the relationship between tool and formed part radius.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENT

In order to gain a better understanding of the phenomena behind the age forming process of the invention, it is well to separately consider and analyze the forming mechanisms at work during the age forming process. This effort can begin by analyzing mechanical forming versus age forming in terms of stress distribution found within the cross section of a specimen undergoing forming. Another tool desirably utilized for analysis is a stress-strain curve representing the outside layer of fibers of a specimen undergoing forming. Through the use of these tools, a clearer picture can be obtained as to how each forming method works to form a piece of material.

Figure 1:
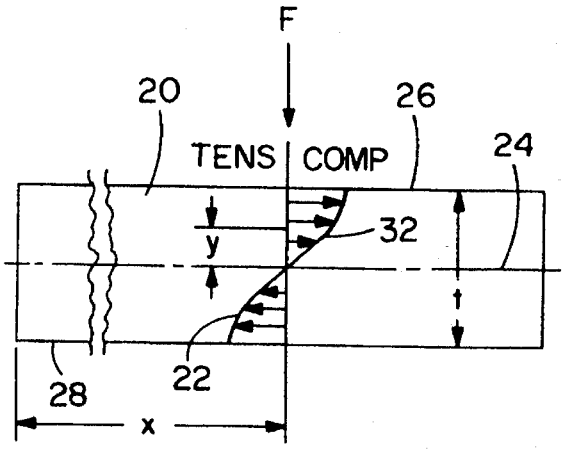
FIG. 1 is a diagrammatic side elevation view illustrative of stress distribution in a constant thickness bar being subjected to pure bending for purposes of explanation of the prior art.

Considering the stress distribution throughout a part 20, depicted for simplicity in FIG. 1 as a constant thickness bar of rectangular cross section, allows a comparison to be drawn between different forming mechanisms. As a force F is applied to the simply supported bar to cause it to assume a radius, stresses diagrammatically indicated at 22 are distributed throughout the thickness of the bar. A neutral surface 24 experiences no stress due to pure bending while the outside fibers experience the greatest stress. A concave side 26 of the bar experiences compressive stresses while a convex side 28 of the bar experiences tensile stresses. According to Hooke's Law, stress is directly proportional to the strain that is experienced when it is within the elastic range of the material. The proportionality constant is known as the modulus of elasticity and is dependent upon material and temperature. The strain experienced by the fibers across the thickness of a specimen depends upon the distance of a particular layer of fibers from the neutral surface.

Figure 2:
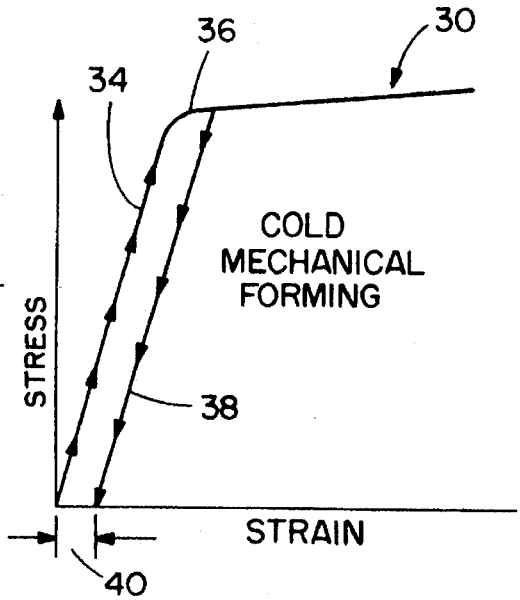
FIG. 2 is a stress-strain graph illustrating the relationship between stress and strain in the outermost layer of material of the bar of FIG. 1 during a cold mechanical forming process, depicting both the elastic range of the material and the deformation in the material after it has been stressed beyond the yield strength of the material.

If the stress induced throughout the bar stays within the elastic range of the material, the bar will return to its original flat configuration with no forming taking place once it is released. Therefore, if the bar is to retain a contour and be formed without the aid of thermal stress relaxation, a significant amount of fibers within the material must be stressed beyond their yield point. The stress-strain curve 30 in FIG. 2 can be used to examine the action involved in forming. The case of imparting a radius to a flat bar shaped part is not strictly a tensile application; rather it is one of bending. Therefore, in reality, the use of a stress-strain curve is only applicable to a single layer of material at a given distance from the neutral surface. Nevertheless, it serves the purpose of illustrating the differences between cold mechanical forming and age forming. For example, the stress-strain curve 30 in FIG. 2 illustrates cold mechanical forming of the bar 20 of FIG. 1 subjected to bending stresses.

Consider the outermost layer of material on what will become the convex side 28 of the bar. Initially the bar is flat and in a stress free state. As the bar is reconfigured to assume a radius, the fibers in the outside surface layer are strained which induces stress. This is illustrated by a stress distribution line 32 (FIG. 1) and by the stress strain curve (FIG. 2) beginning at the origin. The linear portion of the curve, which defines the modulus of elasticity, or Young's modulus, for the particular alloy of the bar 20, continues until the stress level reaches the yield strength 36 of the material. If the bar is released at any point prior to inducing a stress greater than the yield strength 36, it will unload along this same line and return to a flat (i.e., strain free) condition. Once a layer of material is stressed beyond its yield point, the relationship between stress and strain is no longer directly proportional (i.e., it is no longer linear). If at this point the bar is released, it will unload along a line 38 that has the same slope as the linear portion 34 of the load curve 30 but will be offset from the original load line 34 indicating a retained strain 40. The slope is equal to the modulus of elasticity as previously noted. The resulting retained strain 40, referred to as plastic strain, indicates that permanent deformation has taken place.

Although, as earlier stated, age forming generally has significant advantages over cold forming practices, there are occasions when it may be desirable to utilize a cold forming process. The technique of the invention can also be applied to cold forming operations and, indeed, can be applied to any forming operation in which there is a relationship between strain in a member applied by a forming operation and strain retained in the member after the applied strain has been released.

Figure 3A:
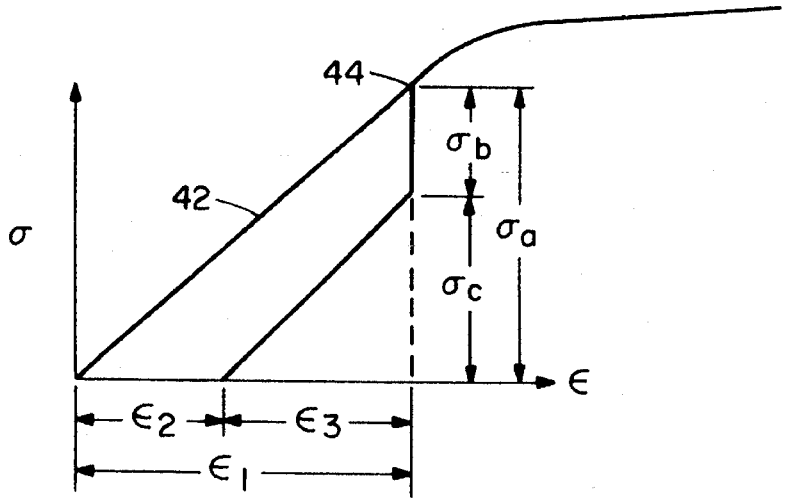
FIG. 3A illustrates a stress-strain graph, similar to FIG. 2, but indicating the result of an age forming process performed within the elastic range of the material.
Figure 3B:
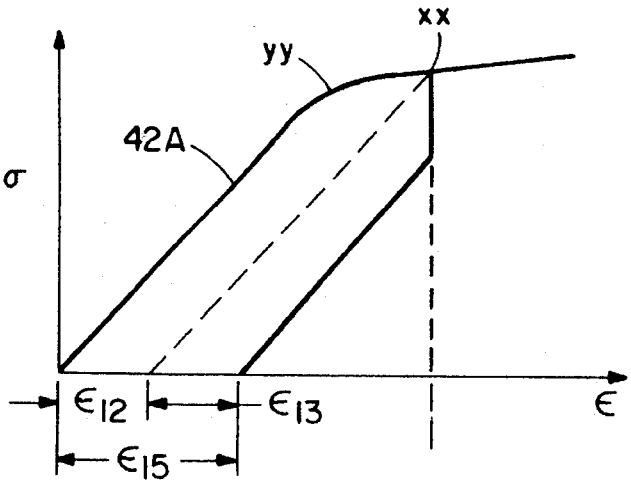
FIG. 3B is a stress-strain graph, similar to FIG. 2, but indicating the result of an age forming process performed when initial loading exceeds the yield point of the material.

Age forming forms a structure by taking advantage of the stress relaxation phenomenal associated with artificial aging. The age forming concept is illustrated by the stress-strain curves in FIGS. 3A and 3B. FIG. 3A depicts a specimen initially stressed below the material's yield strength and FIG. 3B depicts a specimen initially stressed beyond the material's yield strength. Again, consider the outside layer of fibers on what will become the convex side of a formed member, such as convex side 28 of the bar 20 of FIG. 1. These fibers will experience tensile stresses. As the member is strained is indicated by a line 42 (FIG. 3A), the stress level increases proportionally. The vertical distance $\sigma_a$ (FIG. 3A) represents the amount of stress experienced by the fibers of the member while the horizontal distance $\epsilon_1$ represents the amount of strain experienced. Upon reaching a particular radius, the member is held at this constant strain level (as at point 44) and the artificial aging cycle is applied. Due to the metallurgical stress relaxation resulting from the materials' exposure to temperature, the stress level reduces even though the strain remains constant. The amount of stress relaxation that occurs, as indicated at $\sigma_b$, depends upon the material and its related aging temperature as well as the initial level of stress induced. The rate of stress relaxation is greatly enhanced by a higher initial stress level and by a higher aging temperature. However, these factors are limited by the temperature permitted by the selected aging cycle.

Once the aging is complete, the member is cooled and released from its constraints. This allows the member to spring back and physically relax the remaining induced stress. The vertical distance $\sigma_c$ (FIG. 3A) represents the amount of stress relaxed during spring back while the horizontal distance $\epsilon_3$ represents the change in strain. Since strain changes, the shape of the specimen also changes. In this case the specimen is held in contact with the smaller radius of a forming tool and, upon release and following spring back, assumes a larger radius. An amount of strain $\epsilon_2$ is retained by the member indicating permanent deformation.

In FIG. 3A, the practice of age forming has been illustrated within the elastic range of the material. It is in this region that the distinction between age forming and cold mechanical forming is most evident. However, the same principles apply within the inelastic range (above yield) as depicted in FIG. 3B. The most notable difference between age forming a specimen stressed within the elastic range versus one stressed within the inelastic range is best viewed by considering the action along the strain (horizontal) axis. In a specimen stressed to within the inelastic range, the retained strain $\epsilon_{15}$ (FIG. 3B) is composed of two components. A portion of the retained strain $\epsilon_{12}$ results simply due to stressing the specimen beyond the yield point of the material. In FIG. 3B, point xx represents the specimen initially reconfigured to the shape of the forming tool prior to exposure to the aging cycle. At this point, the level of stress is beyond the yield strength of the material. The yield strength is illustrated on the stress-strain curve 42A by point yy. If the specimen being formed were to be released at point xx, prior to exposure to the elevated temperature of the aging cycle, some retained strain $\epsilon_{12}$ would be exhibited simply because a portion of the material has yielded. This is unlike the specimen illustrated in FIG. 3A in which the specimen would return to a flat unstrained condition if released prior to elevated temperature exposure. The total retained strain $\epsilon_{15}$ of FIG. 3B, therefore, is a combination of the retained strain $\epsilon_{12}$ due to yielding of the material and the retained strain $\epsilon_{13}$ due to metallurgical stress relaxation.

In either the elastic or inelastic range, age forming allows permanent deformation to be achieved with lower levels of applied stress than cold mechanical forming. Because of the way that cold mechanical forming works, residual stress levels within formed parts can be quite high. It is here that age forming presents significant advantages. First, the applied stress level required for forming is lower; and secondly, stress relaxation occurs during aging, lowering it even more while the part is held at a constant strain. After release from the forming tool, the age formed part relaxes the remaining induced stress, which is significantly lower than it was at the start of the aging cycle. The result is that the age formed part has the same permanent deformation as the mechanically formed part, but with much lower levels of residual stress.

The amount of stress relaxation experienced by a member during forming becomes the key to determining the amount of springback the member will experience following age forming. Predicting springback is the fundamental requirement to taking advantage of the age forming method. Knowledge of springback is needed to accurately determine forming tool contours.

Figure 4:
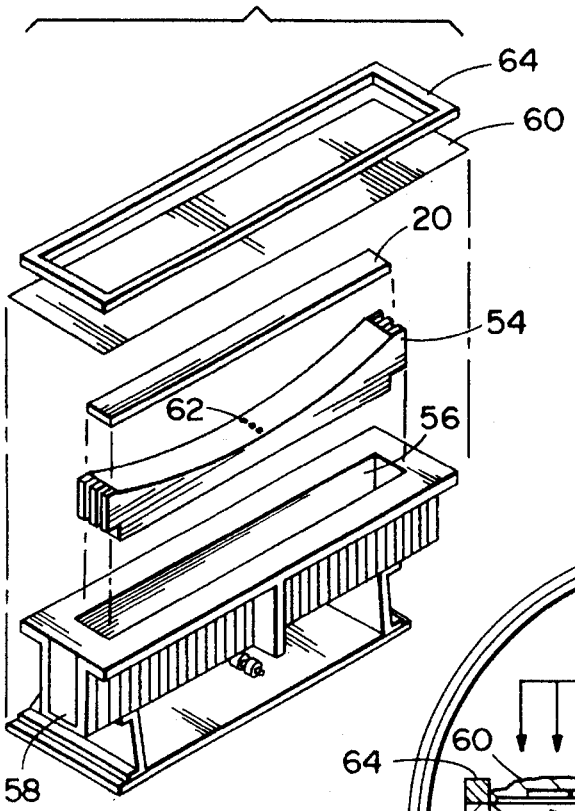
FIG. 4 is a perspective view, exploded, illustrating tooling for autoclave age forming a member such as the bar of FIG. 1.
Figure 5:
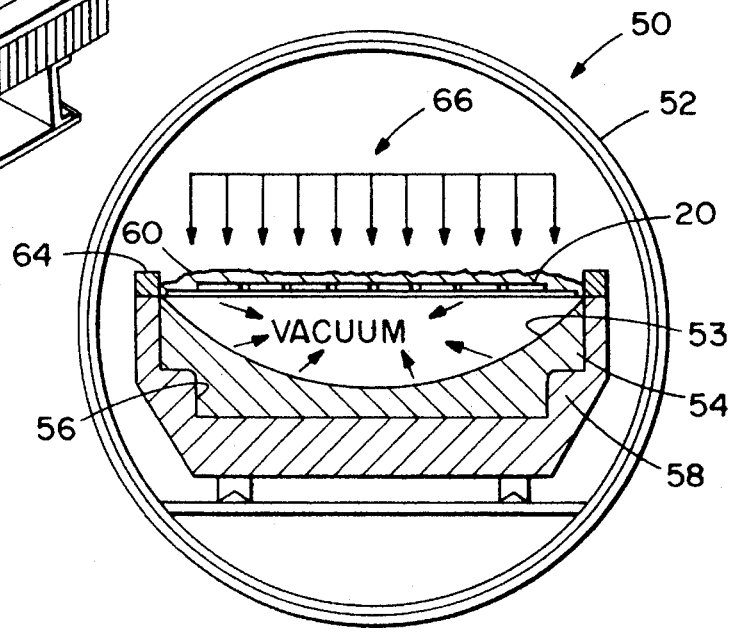
FIG. 5 is a detail cross section view illustrating the items shown in FIG. 4 within an autoclave.
Figure 6A:
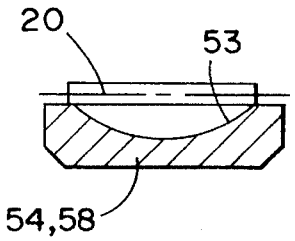
FIGS. 6A, 6B, 6C are successive diagrammatic detail end elevation views, partially in section, illustrating successive steps of the known age forming method.
Figure 6B:
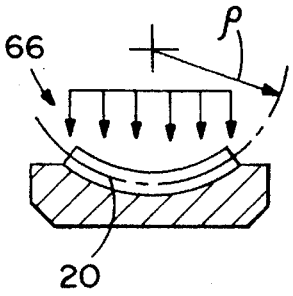

For a brief initial explanation of the autoclave age forming process utilized for purposes of the invention, turn now to FIGS. 4 and 5. An autoclave 50 (FIG. 5) includes a generally thick-walled cylindrical vessel 52 which may typically be capable of withstanding pressures up to 200 psi, total vacuum, and temperatures up to 600° F. With this apparatus, as diagrammatically seen in FIG. 6, the part 20 is forced from an initial unformed condition (FIG. 6A) into intimate contact with the contoured surface 53 of a concave die 54 (FIG. 6B) receivable in a cavity 56 of an autoclave forming tool 58. This is accomplished by covering the top of the part 20, die 54, and forming tool cavity 56 with a temperature resistant vacuum blanket 60, sealing the edges of the blanket, drawing a vacuum through a plurality of vacuum ports 62 (FIG. 4) on the tool cavity beneath the part, and, if desired, also applying pressure to the upper surface of the part. A sealing frame 64 is removably mounted on the forming tool 58 to maintain the positioning of the vacuum blanket 60. The vacuum pulled underneath the part ensures that trapped air will not prevent it from obtaining total contact with the forming tool. The forming tool contour is designed to overform the part, allowing for springback. As noted above, pressure may be optionally applied to the part as indicated by arrows 66 to assure firm and continuous coextensive engagement of the die 54 by the part 20.

Figure 6C:
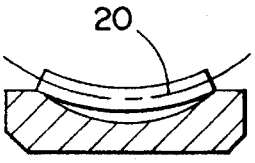

Up to this point, temperature has not been applied to the part, so that unless the bending stress applied has exceeded the yield point of the material, no permanent deformation has been achieved and the part is still within the elastic range of the stress strain diagram. This condition provides the most significant feature of age forming, since it can be performed at lower applied stress levels than conventional forming techniques. If the part were released from the vacuum and pressure holding it to the tool, it would essentially spring back to its initial flat condition (FIG. 6 A). However, with the application of heat at appropriate temperatures for appropriate periods of time, the part will, after the forming process and after its release from the tool, spring back to an intermediate position as indicated in FIG. 6C.

The foregoing presents an early construction of an autoclave tool suitable for the process of the invention. However, it is not all inclusive. More recently, tools have been constructed with a skeleton framework of contoured boards covered by a contoured aluminum skin or caul plate. The pressure differential is created between the top of the panel and the caul sheet. The contour boards Are not exposed to the pressure differential, except for those forces transmitted through the caul. A sealing frame is no longer employed to seal the vacuum bag to the tool. Instead, the vacuum seal is now maintained by adhesively attaching the bag to the surface of the caul with a temperature resistant putty. The newer tooling is simple, lightweight, and less costly to build. Nor does the tooling have to be concave; it can just as easily be convex. Also, production tools are not generally cylindrical, although individual contours are constructed of circular segments. While vacuum and pressure are preferably employed to obtain the appropriate applied strain, purely mechanical expedients, such as matched dies or clamps, may also be used. Much of the tooling is simply a function of the desire to use a pressure differential for forming. Age forming itself can be employed in both autoclaves and furnaces using both pressure and mechanical means. The method for developing the forming tool contour is the same, regardless of whether a pressurized autoclave tool or a mechanically clamped furnace tool is desired. Springback is calculated as a function of the material, its thickness, and the final contour desired only. Regardless of whether age forming is performed in a furnace or autoclave, the material's response to aging remains the same.

Until the advent of the invention disclosed in U.S. Pat. No. 5,168,169, springback was defined as the difference between the chord height of the tool and the chord height of the formed specimen. However, it was found that this method was very restrictive and limited to predicting the springback of a constant thickness bar specimen formed to a radius. The old method was based purely on the percent change in chord height. The stress strain curve was not used. This method was improved by using the stress relaxation curve and strain retention curve prediction method as indicated in U.S. Pat. No. 5,168,169 recited above, the disclosure of which is hereby incorporated herein in its entirety by reference. However, the improved method, just noted, is based on experimental observations and was limited to the range of test data that was used.

Figure 7:
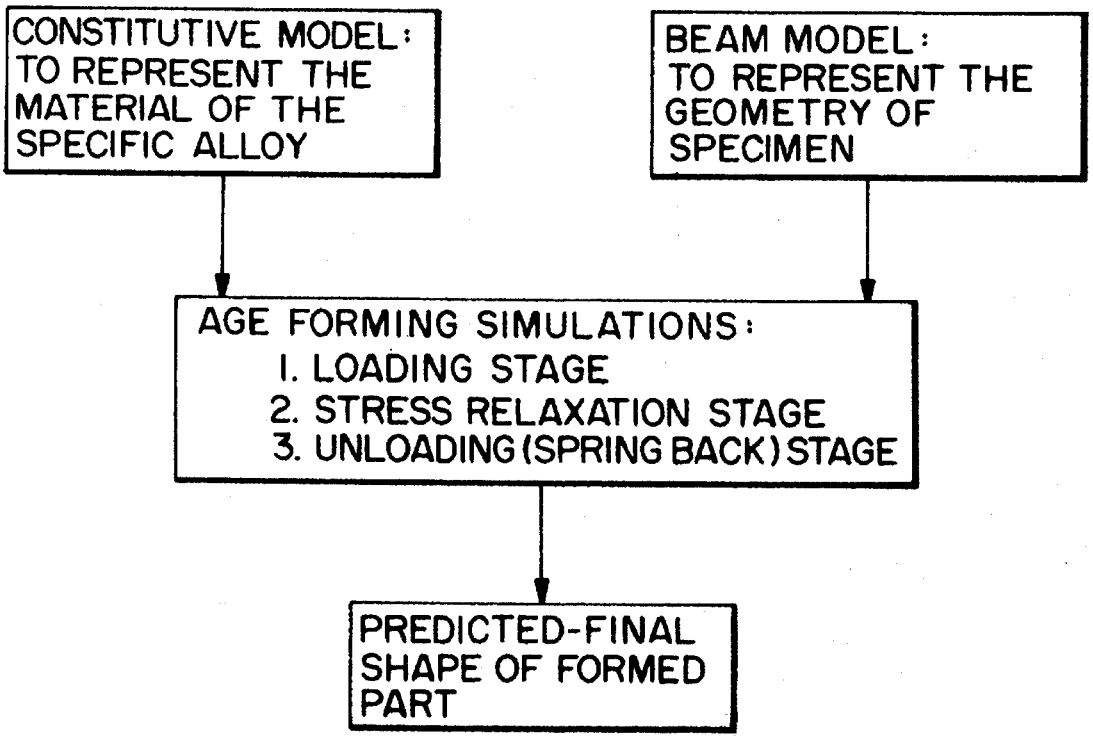
FIG. 7 is a basic flow chart of a known simulation model.

A new springback prediction method was subsequently disclosed in U.S. Pat. No. 5,341,303 and was based upon the application of a unified viscoplastic model to simulate the age forming process, providing a much more complete analytical device than previously available to the tool designer. The age forming method can be broken down into its various stages: loading, stress relaxation, and springback. A basic flow chart depicting that method is presented in FIG. 7. In that method, equations representing the condition model were used to more fully describe what is physically and metallurgically happening to the material being formed. These equations attempted to describe the laws governing the physical nature of the material and changes taking place during the age forming process.

These equations represented physical phenomena such as: elastic strain, inelastic strain, stress relaxation, creep, and the like, and the history of time dependent load application and temperature exposure. Unique constants were required to accurately represent specific materials. The constants were determined by manipulating the constitutive equations until they represented the age forming process physically observed in test specimens. Once determined, the constants in conjunction with the constitutive model fully represented the material at hand as it was subjected to the age forming process. Theoretically, any model geometry could then be analyzed to determine needed age forming tool contours. More properly, the method of U.S. Pat. No. 5,341,303 was a modelling and simulation technique rather than a prediction technique. Mathematical modelling and simulation of age forming was flexible and incorporated material properties and part geometry in an appropriate format. The model used that information to obtain the desired contour of a specimen being formed and to predict the residual stress in that specimen. Integrating materials, as represented by the constitutive model, and geometry into the model for the forming method allowed it to be adaptable to different combinations of part configuration and metal alloy. The benefits of a mathematical modelling and simulation of the age forming method related to the ability to know the degree of deformation required to compensate for material springback and the characteristic forming tendencies associated with a specific part configuration. The main benefit was to analytically determine the forming parameters thereby eliminating the need for developing costly and time consuming empirical data.

A methodology for simplifying the analysis in bending of integrally stiffened panels has now been developed. Panels that have integrally machined features (blades, pad-up areas, and the like) are included in this definition. According to this latest methodology, a function is derived that relates the behavior of the integrally stiffened panel to that of an equivalent member of constant thicknesses. The resulting equivalent thickness member can be used in conjunction with a material specific bending model in the design of a forming tool or process. Although this disclosure describes the development as it relates to a bending situation, the theory applies to other states of stress and strain, as well.

The equivalent thickness analogy can be developed given the following information:

(1) An equation that defines the behavior of an alloy when it is subjected to a range of applied bending strains. For cold working processes, this equation could be taken from the stress strain curve for the alloy. For age forming, this equation could be either the stress relaxation or strain retention equation. For a background discussion of the stress strain curve and of the stress relaxation and strain retention equations, the reader is directed to U.S. Pat. No. 5,168,169.

(2) Test data taken from a specific integrally stiffened panel configuration of the alloy in question, the panels having been subjected to a comparable range of applied bending strains.

A function can be developed that defines the behavior of the integrally stiffened panel in terms of an equivalent thickness. The equivalent thickness represents a member of constant thicknesses that would behave the same as the integrally stiffened one, when subjected to the same applied bend.

The equation that defines the behavior of the alloy when subjected to a range of applied strains can take the form of a polynomial equation, such as:

$$y=Ax^2+Bx+C \tag{1}$$

where:

y is the strain retained in the part after the bend;

x is the strain applied by the bend; and

A, B, and C are material specific constants.

For the case of a beam of rectangular cross section:

$$y=(t/2)/(R_p-t/2)=t/(2R_p-t);\text{ and} \tag{2}$$

$$x=(t/2)/(R_b-t/2)=t/(2R_b-t) \tag{3}$$

where:

t is the thickness of the cross section;

$R_p$ is the outer radius of the beam following the bend; and $R_b$ is the outer bend radius (largest radius).

Rewriting Equation (1) for the case of a beam of rectangular cross section in bending and substituting for x and y yields:

$$t/(2R_p-t)=A\ (t/(2R_b-t))^2+B\ (t/(2R_b-t))+C \quad (4)$$

Setting the left side of the equation equal to zero and rewriting the equation in terms of t yields:

$$0=(B-A-C-1)t^3+(2AR_p-2BR_p-2BR_b+2CR_p+4CR_b+4R_b)t^2 +(4BR_pR_b-8CR_pR_b-4CR_b^2-4R_b^2)t+(8CR_p\ R_b^2) \quad (5)$$

By so doing, the expression has now been reduced to a third order polynomial equation of the form:

$$ax^3+bx^2+cx+d=0 \quad (6)$$

where:

$a=(B-A-C-1)$, $b=(2AR_p-2BR_p-2BR_b+2CR_p+4CR_b+4R_b)$, $c=(4BR_p-8CR_pR_b-4CR_b^2-4R_b^2$ $d=(8CR_pR_b)$, and x=t (the thickness of the cross section).

Since equation (6) has been written in terms of a third order polynomial equation, its roots can be obtained using a numerical technique, such as Newton's Method. One of the roots will correspond to the equivalent thickness for the given bending situation.

For purposes of simplicity, second and third order polynomial equations are used throughout this disclosure. However, it should be recognized that the methods presented herein lend themselves to other forms of mathematical representation including other levels of polynomial expression.

Now, consider applying the equivalent thickness analogy to an integrally stiffened panel. The equivalent thickness analogy allows panels having complex integral stiffening systems to be represented in the form of a function that defines their behavior in terms of members of constant thicknesses. Given a data point comprising a forming tool bend radius and the radius that results in the member after the applied bend is released, the expression in equation (6) can be solved to provide an equivalent constant thickness that would yield the same formed part radius when subjected to the prescribed bending situation. Such a data point can be obtained from a bend test conducted with an integrally stiffened panel of a specific alloy. A series of bend tests, conducted over a range of applied bend radii, will produce the data points necessary to describe the behavior of the panel over the defined range of applied bending strains. At each finite point, the bend radius and the resulting panel radius will yield an equivalent thickness when put in the form of equation (6) and solved.

Figure 8A:
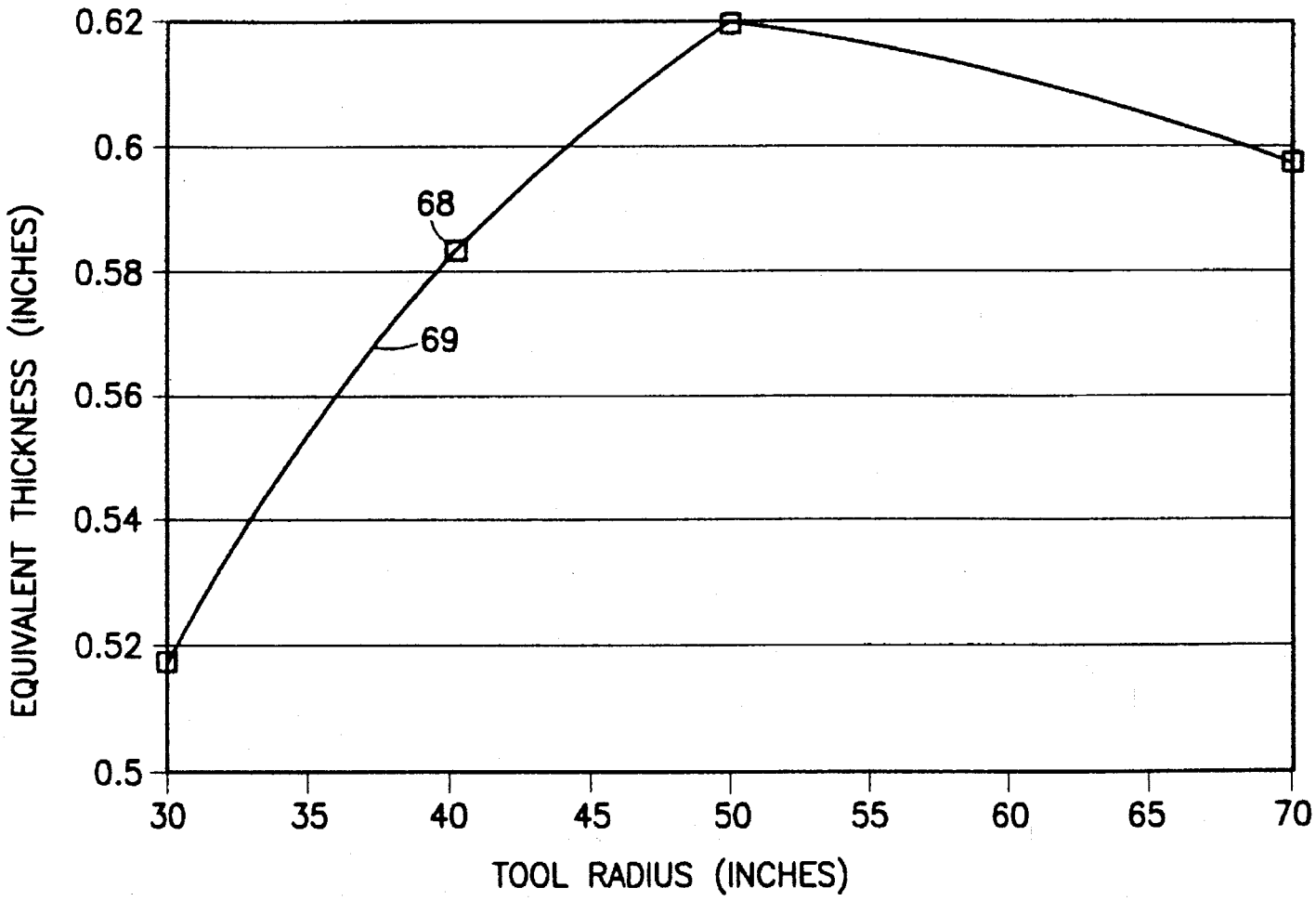
FIG. 8A is a graph depicting the relationship between the forming tool radius and the equivalent thickness of a member of constant thickness.
Figure 8B:
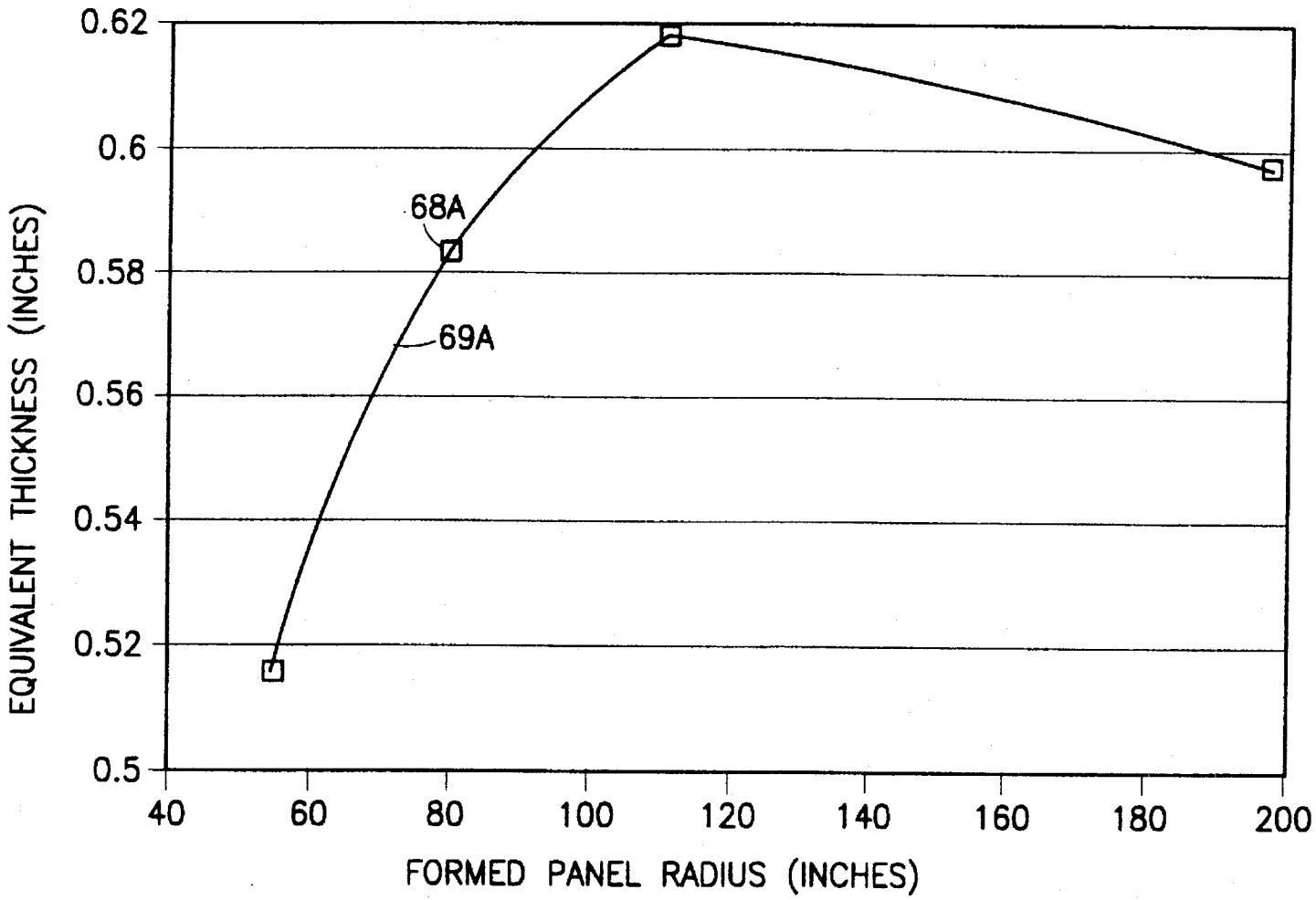
FIG. 8B is a graph depicting the relationship between the formed panel radius and the equivalent thickness of a member of constant thickness.

A series of data points 68 (FIG. 8A) can be solved for and the resulting relationship between the bend radius and the equivalent thickness can be described by a smooth curve 69 running through the individual data points. A similar relationship can be developed between the formed panel radius and the equivalent member thickness which can also be described by a smooth curve 69A running through individual data points 68A as seen in FIG. 8B. FIGS. 8A and 8B present the equivalent thickness analogy for 0.5 inch blade stiffened, isogrid panels produced from aluminum alloy 2024-T351 and age formed to the T851 temper.

Table 1 provides an example of the calculations used to develop the curves 69, 69A of FIGS. 8A and 8B.

TABLE 1

| FORMING TOOL RADIUS | FORMED PART RADIUS | STRAIN RETENTION CURVE COEFFICIENTS | | | CUBIC EQUATION COEFFICIENTS | | | | EQUIVALENT THICKNESS |
|---|---|---|---|---|---|---|---|---|---|
| (IN.) | (IN.) | A | B | C | a | b | c | d | (IN.) |
| 30 | 54 | 46.01546 | 0.15214 | 0.00001 | −46.86333 | 5064.11259 | −2614.32870 | 5.11675 | 0.51676 |
| 40 | 81 | 46.01546 | 0.15214 | 0.00001 | −46.86333 | 7577.69005 | −4428.64688 | 13.64467 | 0.58345 |
| 50 | 113 | 46.01546 | 0.15214 | 0.00001 | −46.86333 | 10549.90082 | −6562.28561 | 29.74244 | 0.61917 |
| 70 | 198 | 46.01546 | 0.15214 | 0.00001 | −46.86333 | 18420.58219 | −11166.88707 | 102.14553 | 0.59785 |

Figure 9A:
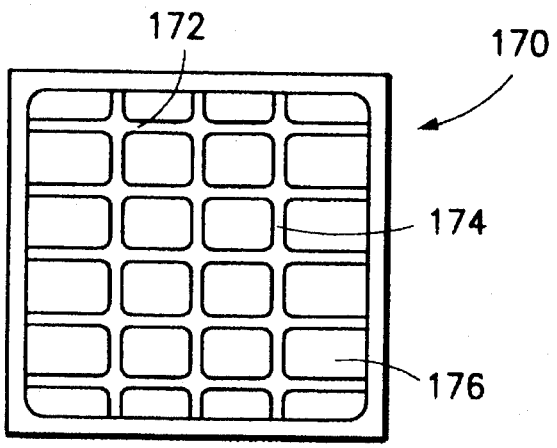
FIGS. 9A, 9B, and 9C are diagrammatic plan views, respectively, of an orthogrid panel, of an isogrid panel, and of a blade stiffened panel.
Figure 9B:
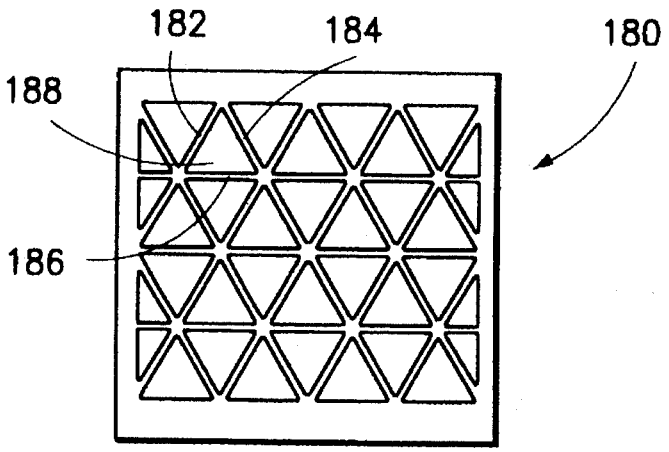
Figure 9C:
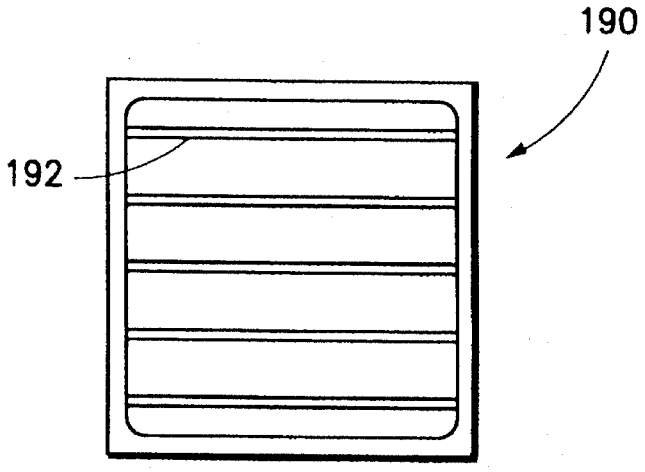

The equivalent thickness methodology of the invention can be used in the design of age forming tools for fabricating a wide variety of stiffened structures, as desired. As illustrated in the drawings, these might be, for example, orthogrid panels 170 depicted in FIG. 9A which have integrally machined ribs 172, 174 that intersect at 90° angles, thereby giving them a square or rectangular "waffle" pattern of repetitive pockets 176. Isogrid panels 180 depicted in FIG. 9B have integrally machined ribs 182, 184, 186 that intersect at acute angles, thereby giving them a triangular "waffle" pattern of repetitive pockets 188. Blade stiffened panels 190 depicted in FIG. 9C have a plurality of parallel elongated unconnected stiffening members 192 which can themselves be of a variety of cross sections. Such cross sections may be, for example, limit sections, "J" sections, or "Z" sections. In the present disclosure, all references to panels are intended to be exemplary only. The method disclosed herein can likewise be applied to any stiffening geometry, whether isogrid, orthogrid, blade stiffened, or other construction. The method of the invention operates by relating the forming behavior of a complex, integrally stiffened, panel to that of a constant thickness, rectangular bar specimen of the panel alloy. The equivalent thickness allows the use of a stress relaxation or strain retention curve, or equation, as developed in U.S. Pat. No. 5,168,169, for the design of an age forming tool. Such a strain retention curve 70 is presented in FIG. 10.

Figure 11:
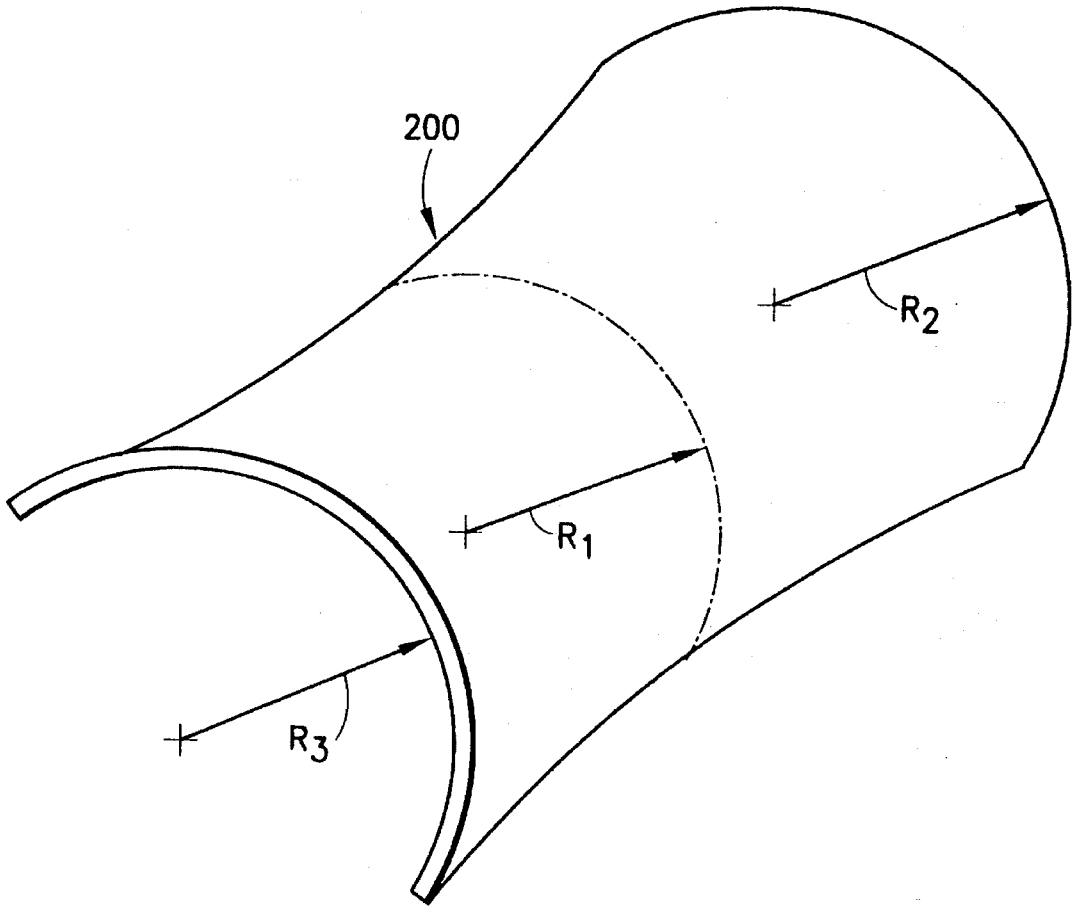
FIG. 11 is a diagrammatic representation of a stiffened panel having an hour glass shape.

The method allows for non-symmetrical stiffening and transverse curvature compensation. Non-symmetrical stiffening allows panels that have changes in blade geometry (height, thickness, spacing, and blade type) to be modeled. Transverse curvature is a phenomenon that occurs when integrally stiffened panels are formed. Due to reactions between the frame and rib elements, integrally stiffened panels often times do not spring back uniformly after forming. More specifically, in such instances, the panels will not spring back to a uniform curvature from end to end. As illustrated in FIG. 11, for example, a central portion of a panel 200 retains a tighter radius of curvature, $R_1$, than outboard portions having radii of curvature $R_2$ and $R_3$, thereby resulting in a characteristic hourglass shape. Numerous other shapes can occur. The forming process must be adjusted to compensate for such transverse curvature.

Figure 10:
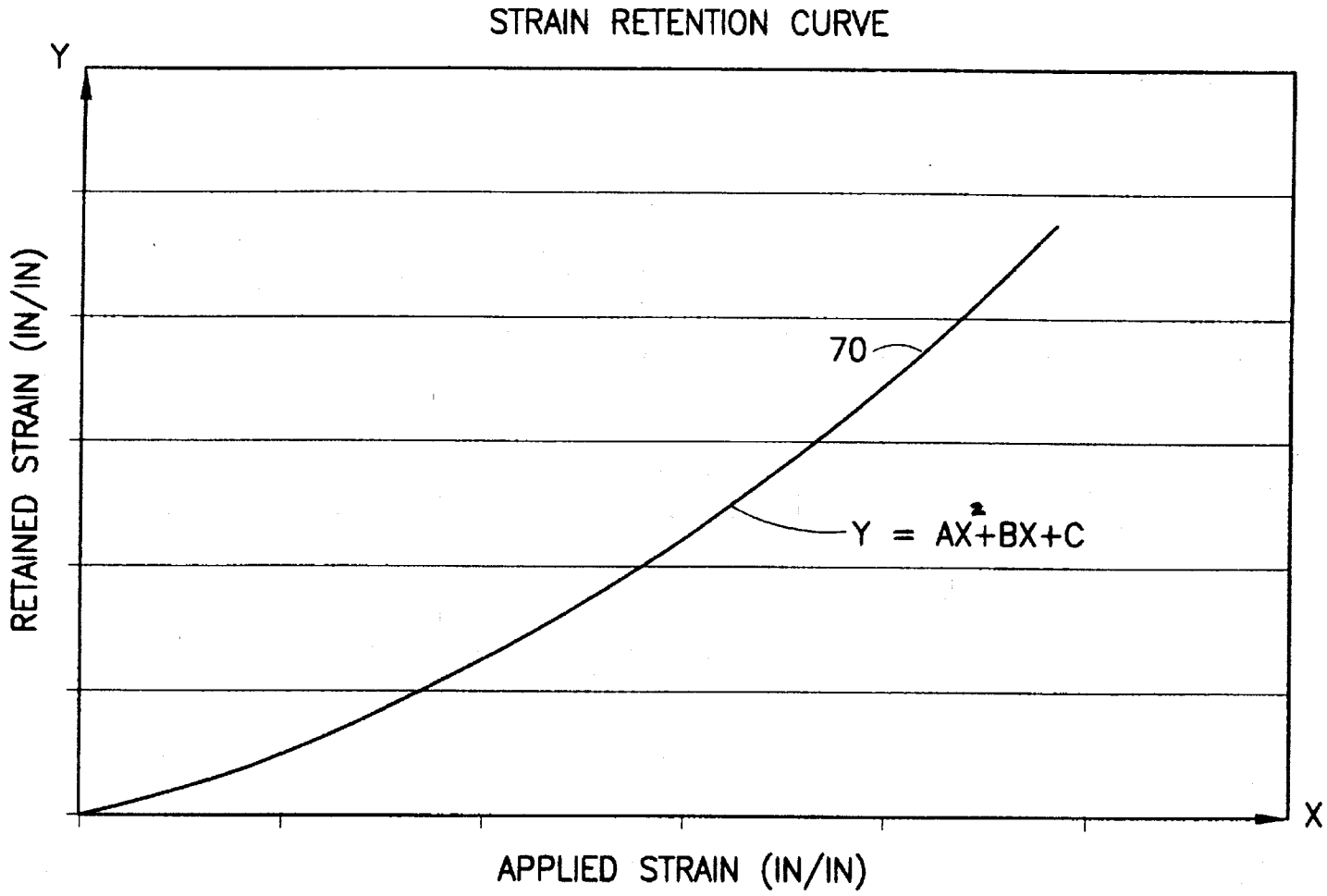
FIG. 10 is a graph depicting retained strain in a member as a function of applied strain.
Figure 12A:
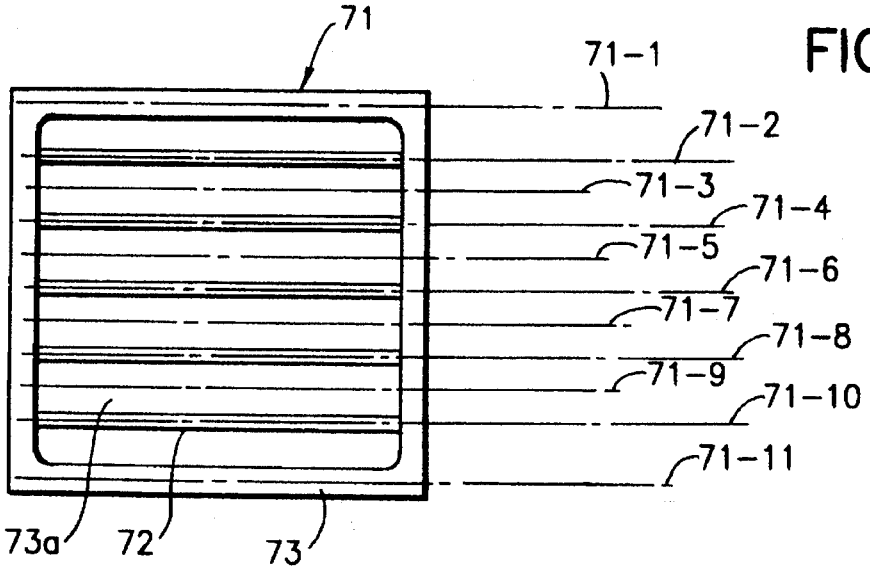
FIG. 12A diagrammatically represents a top plan view of a stiffened panel.
Figure 12B:
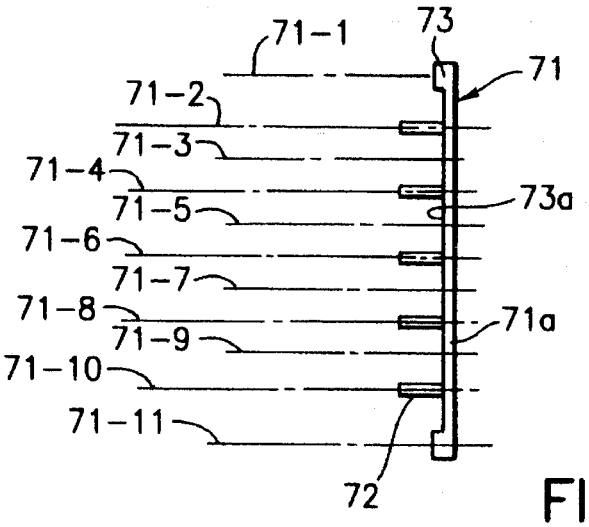
FIG. 12B diagrammatically represents an end view of the stiffened panel of FIG. 12A.
Figure 12C:
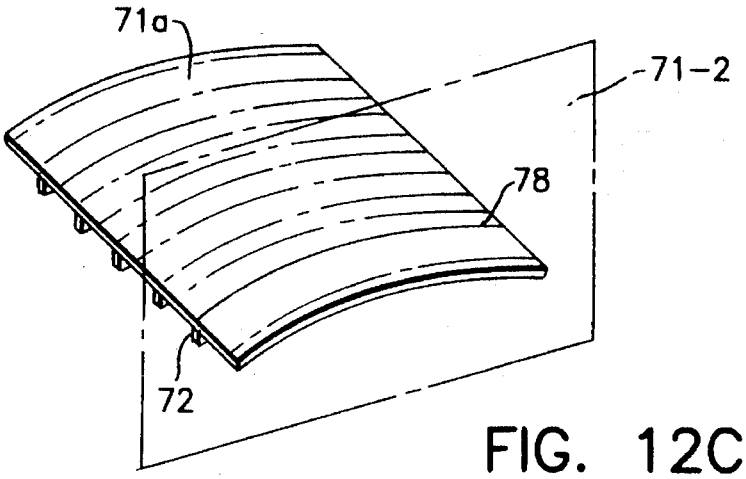
FIG. 12C diagrammatically represents a perspective view of the stiffened panel of FIGS. 12A and 12B.

Steps in the design of an age forming tool for fabricating a finished blade stiffened panel using the equivalent thickness methodology of the invention will now be presented. A blade stiffened panel is referred to since it is of a simpler construction than isogrid and orthogrid panels and the like, but it will be understood that the methodology of the invention is applicable to those more complex structures as well. With reference initially to FIGS. 12A, 12B, and 12C, a stress relaxation or strain retention curve for the alloy in question is developed. As previously noted, this can be accomplished with constant thickness bar specimens in the manner disclosed in U.S. Pat. No. 5,168,169. FIG. 10 displays the strain retention curve 70 defined by the equation $$y=Ax^2+Bx+C \quad (1)$$

where y is the retained strain and, for the case of a constant thickness bar, $$y=\frac{t}{2R_p-t};$$

$R_p$ is the formed part radius; and t is the bar thickness; and x is the applied strain and for the case of a constant thickness bar, $$x=\frac{t}{2R_b-t};$$

$R_b$ is the tool radius and t is the bar thickness; and

A, B and C are alloy specific coefficients of the strain retention equation.

The strain retention curve provides a model of the response of the material, that is, alloy, to a range of applied strains. At this point, a series of panel forming tests are conducted. The term "series" is intended to refer to the performance of at least two tests on a similar number of panel specimens, although at least three tests would be preferred for accuracy of the results. For such tests, the panel specimens should duplicate the stiffening geometry and alloy of the application intended for the finished panel. The panel specimens may be subscale or full scale. The panel specimens are formed in forming tools having a range of forming tool radii, so that the response of the stiffening system can be examined and modeled for the range of applied strains.

Figure 13A:
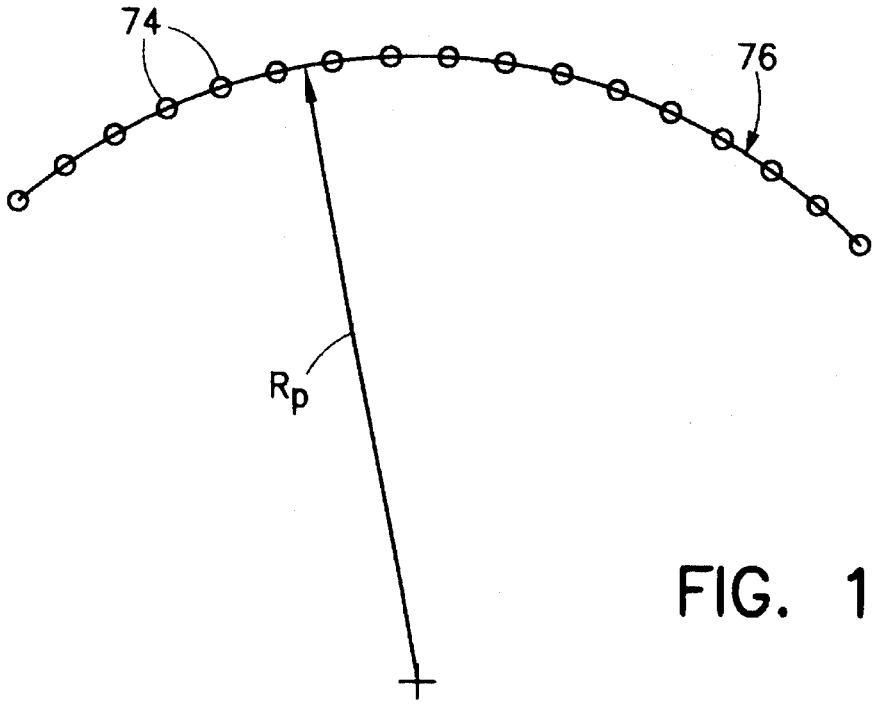
FIG. 13A is a graphic representation of a method of fitting a circular arc of known radius to the curvature of the stiffened panel of FIGS. 12A, 12B, and 12C according to the present invention.
Figure 13B:
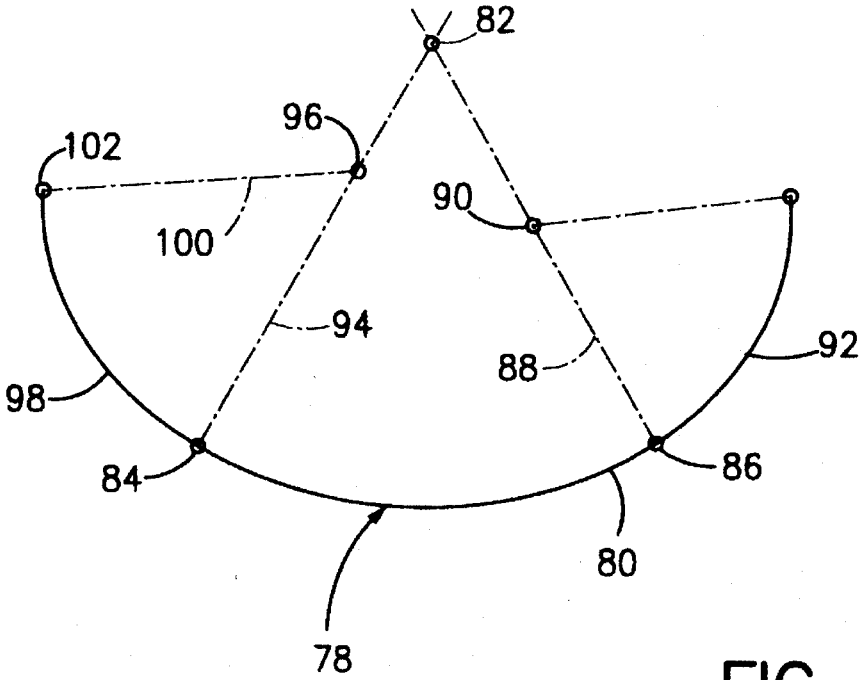
FIG. 13B is a graphic representation of a method by means of which a smooth continuous curve is achieved from a plurality of circular arcs of different radius utilizing the present invention.

As the next step of the process, the contour of each formed panel specimen is mapped. Viewing FIGS. 12A, 12B, and 12C, measurements of the contour should be made at those locations at which there are characteristic features (stiffeners, pockets, frames, or changes in panel curvature or thickness). This may be achieved at a plurality of spaced, parallel cuts or slices represented by planes 71-1 . . . 71-11 across the panel specimen. Measurements may be made, for example, that correspond to the centerline of each transverse stiffener 72. The measurements should be used to determine best-fit radii at each of the plane locations. If the fit is acceptable, that plane should contain a best-fit circular arc. In other cases, each plane should be represented by a series of circular arcs, which are tangent to each other. In many cases, a single arc will suffice, as seen in FIG. 13A, individual measurement points being indicated by reference numeral 74 to define a completed arc 76. However, there may be instances in which a series of complementary circular arcs, tangent to one another, will necessarily be joined to define a compound completed arc 78 as seen in FIGS. 12C and 13B. In FIG. 12C, the compound completed arc 78 is defined as the intersection between an outer surface **71*a* of the panel specimen 71** and the plane 71-2. A procedure for developing such a compound completed arc will now be described.

The procedure is initiated, using trial and error techniques, by fitting a circular arc 80, for example, to the most central segment of the compound completed arc 78 (FIG. 13B). The circular arc 80 has a center point 82 and extends between end points 84 and 86. A line 88 which is a radius of the circular arc 80 is drawn so as to join center point 82 with end point 86. Thereupon, a center point 90 is located on the line 88 such that the distance between the center point 90 and the end point 86 is the radius of a circular arc 92 adjacent the circular arc 80 which, like the arc 80, fits an adjacent portion of the compound completed arc 78. To develop the other side of the compound completed arc 78, a line 94 is extended between the center point 82 and the end point 84. A center point 96 for a circular arc 98 which fits another adjacent portion of the compound completed arc 78 is properly positioned on the line 94. A line 100 extending between the center point 96 and an end point 102 for the circular arc 98 distant from the end point 84 represents a radius for the circular arc 98.

Throughout the procedure just described, it will be appreciated that the circular arcs 98 and 80 are mutually tangent at the end point 84 and, similarly, that the circular arcs 92 and 80 are mutually tangent at the end point 86. In this fashion, a smooth transition is achieved from each circular arc to its adjacent circular arc or arcs. This procedure is performed for each of the cuts represented by the planes 71-1 . . . 71-11, as seen in FIGS. 12A, 12B, and 12C. It will also be appreciated that there may be a very large number of such cuts, or planes, closely spaced together to improve upon the transition from one plane to its adjacent plane. In this manner, a smooth surface flowing from one tool curve to the next can be obtained which represents the desired predicted surface contour of the autoclave age forming tool. Three dimensional surfaces can be constructed through the individual tool curves. These surfaces can be analyzed and used to generate additional tool definition, such as might be needed for the fabrication of the tool.

As just noted, the contour of each formed panel specimen is represented by a series of parallel circular arcs. However, because of transverse curvature, the radius of the arcs will not be the same. For each plane 71-1 . . . 71-11, there is a relationship between the forming tool radius, $R_b$ and the radius of each arc, either 76 or 78, defining the contour of the panel specimen.

In Table 2, a panel specimen formed in a 50 inch radius, $R_b$, tool has been divided into eleven planar cuts. Each planar cut has been represented by a circular radius $R_p$. For each planar cut, there is a demonstrated relationship between $R_b$ and $R_p$ as appears in Table 2.

TABLE 2

| Plane No. | Tool Radius $R_b$ (in.) | Panel Radius $R_p$ (in.) |
|---|---|---|
| 71-1 | 50 | 110 |

TABLE 2-continued

| Plane No. | Tool Radius $R_b$ (in.) | Panel Radius $R_p$ (in.) |
|---|---|---|
| 71-2 | 50 | 109 |
| 71-3 | 50 | 108 |
| 71-4 | 50 | 107 |
| 71-5 | 50 | 106 |
| 71-6 | 50 | 105 |
| 71-7 | 50 | 106 |
| 71-8 | 50 | 107 |
| 71-9 | 50 | 108 |
| 71-10 | 50 | 109 |
| 71-11 | 50 | 110 |

This data indicates symmetrical stiffening but stiffening may not always be symmetrical. Note that, relating the data of Table 2 to the representative panel 200 illustrated in FIG. 11, the representative panel 200 has a 105 inch radius in its center and a 110 inch radius at its ends.

For each combination of tool radius and formed panel radius, an equivalent, constant thickness specimen can be determined that will produce the formed panel radius when formed in a tool having the tool radius indicated.

Once again, consider the strain retention equation which, as previously stated, may be of the form:

$$y=Ax^2+Bx+C \quad (1)$$

Each combination of tool radius and formed panel radius can be substituted into the strain retention equation and solved for thickness, t. This thickness is the equivalent thickness that would spring back to the formed panel radius, $R_p$, when age formed in a tool of the tool radius, $R_b$.

Equivalent thicknesses are available from the test panel data. For one test panel, this might appear as in Table 3:

TABLE 3

| Plane No. | Tool Radius, $R_b$ | Panel Radius, $R_p$ | Equivalent Thickness, t |
|---|---|---|---|
| 71-1 | 50 | 110 | 1.68 |
| 71-2 | 50 | 109 | 1.71 |
| 71-3 | 50 | 108 | 1.77 |
| 71-4 | 50 | 107 | 1.82 |
| 71-5 | 50 | 106 | 1.85 |
| 71-6 | 50 | 105 | 1.86 |
| 71-7 | 50 | 106 | 1.85 |
| 71-8 | 50 | 107 | 1.82 |
| 71-9 | 50 | 108 | 1.77 |
| 71-10 | 50 | 109 | 1.71 |
| 71-11 | 50 | 110 | 1.68 |

The data can be represented by a curve or by an equation. Each test using a different tool radius will yield a different curve. Thus, viewing FIG. 14, curves 106, 108, and 110 are depicted resulting from forming, respectively, in a 50-inch radius tool, in a 100-inch radius tool, and in a 150-inch radius tool.

Figure 14:
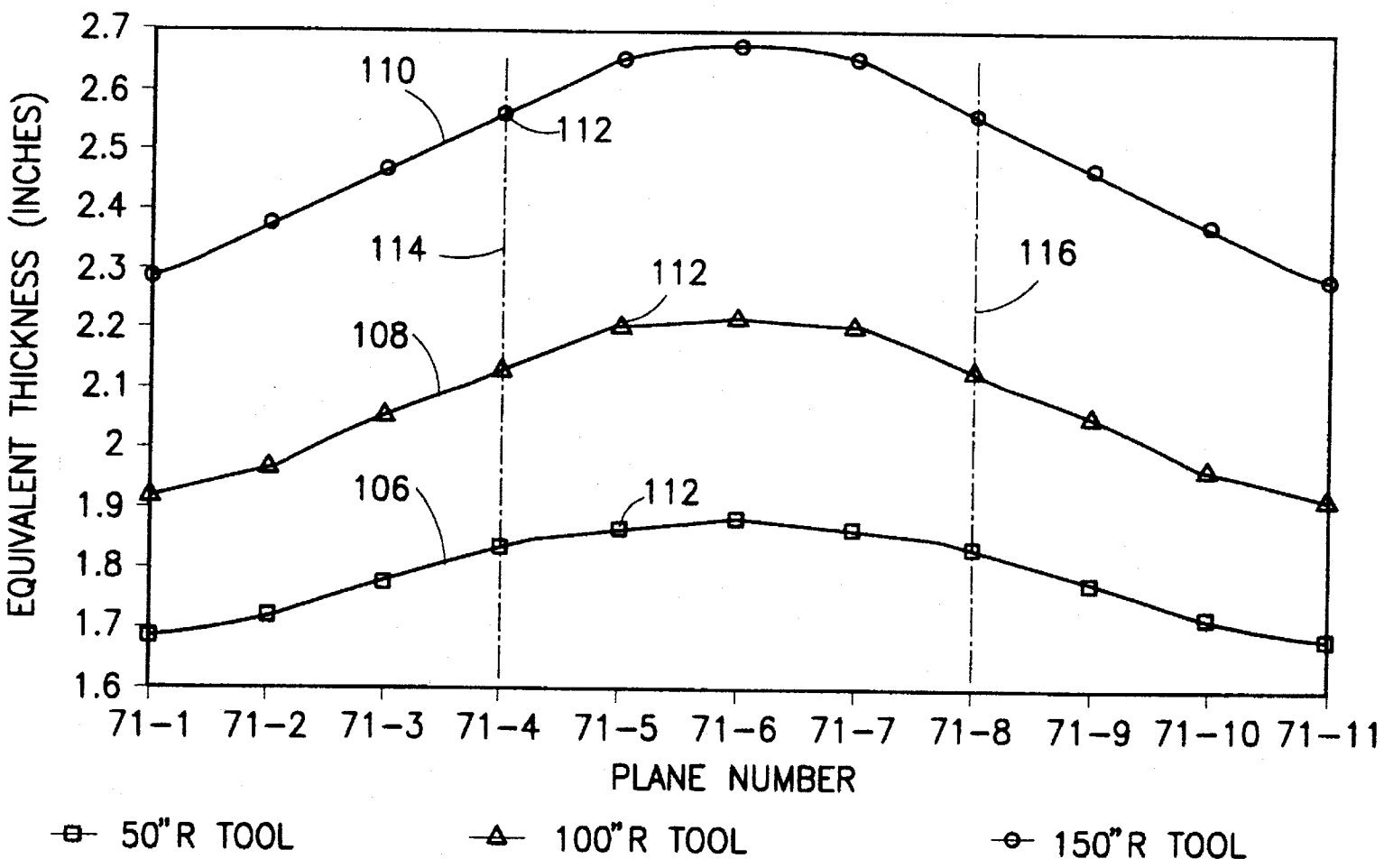
FIG. 14 is a graph depicting equivalent thickness at a plurality of spaced locations across three test panels.

With data thus available from a series of panel tests, contour measurements are taken at the same location on each panel specimen 71 so that certain data points (or measurement locations) 112 correspond to the same panel geometry (stiffeners, pockets, frames, and the like) from one panel to the next. As seen in FIG. 14, for example, those data points 112 on the curves 106, 108, 110 also lie on lines 114, 116 intended to correspond to blade stiffeners.

Now, for each discrete measurement location or plane (FIGS. 12A, 12B, 12C), there are three or more combinations of formed panel radius, $R_p$, and equivalent thickness, t, which were earlier determined from the number of panel specimen tests performed. These combinations of data can be used to develop equations that relate formed panel radius, $R_p$, and equivalent thickness, t. The panel specimen 71 illustrated in FIGS. 12A, 12B, and 12C has been divided into eleven imaginary planes and has yielded the data provided in Table 4. With regard to Table 4, the end regions cut by the planes 71-1 and 71-11 may be considered to be frames 73 and the regions lying between stiffeners 72 to be pockets 73*a*. Also, in this instance, the stiffeners are referred to as blades.

TABLE 4

| PLANE NO. | PANEL GEOMETRY | 50" RADIUS TOOL | 100" RADIUS TOOL | 150" RADIUS TOOL |
|---|---|---|---|---|
| 71-1 | FRAME | 1.68 | 1.92 | 2.28 |
| 71-2 | BLADE #1 | 1.71 | 1.96 | 2.35 |
| 71-3 | POCKET #1 | 1.77 | 2.04 | 2.45 |
| 71-4 | BLADE #2 | 1.82 | 2.11 | 2.54 |
| 71-5 | POCKET #2 | 1.85 | 2.18 | 2.63 |
| 71-6 | BLADE #3 | 1.86 | 2.19 | 2.66 |
| 71-7 | POCKET #3 | 1.85 | 2.18 | 2.63 |
| 71-8 | BLADE #4 | 1.82 | 2.11 | 2.54 |
| 71-9 | POCKET #4 | 1.77 | 2.04 | 2.45 |
| 71-10 | BLADE #5 | 1.71 | 1.96 | 2.35 |
| 71-11 | FRAME | 1.68 | 1.92 | 2.28 |

Thus, for each measurement location, a set of data is provided corresponding to three tools and three equivalent thicknesses along with three formed part, or panel, radii.

For each discrete location (blade, pocket, frame, and the like), an equation can be developed that relates part radius, $R_p$ to equivalent thickness, t. These are presented in Table 5 which, for simplicity, is limited to the first three planes of FIG. 12A but, of course, is applicable for all of the planes of FIG. 12A.

TABLE 5

| PLANE NO. | EQUATION |
|---|---|
| 71-1 | $y = Dx^2 + Ex + F$ < FOR THE FRAME |
| 71-2 | $y = Gx^2 + Hx + I$ < FOR BLADE #1 |
| 71-3 | $y = Jx^2 + Kx + L$ < FOR POCKET #2 |

In the equations presented in Table 5, y is the equivalent thickness and x is the formed part radius, $R_p$, and D, E, F, G, H, I, J, K, and L are constants specific to each second order equation.

Equations are now available that relate the discrete geometry of the test panels to an equivalent thickness of a member of uniform thickness.

Figure 15:
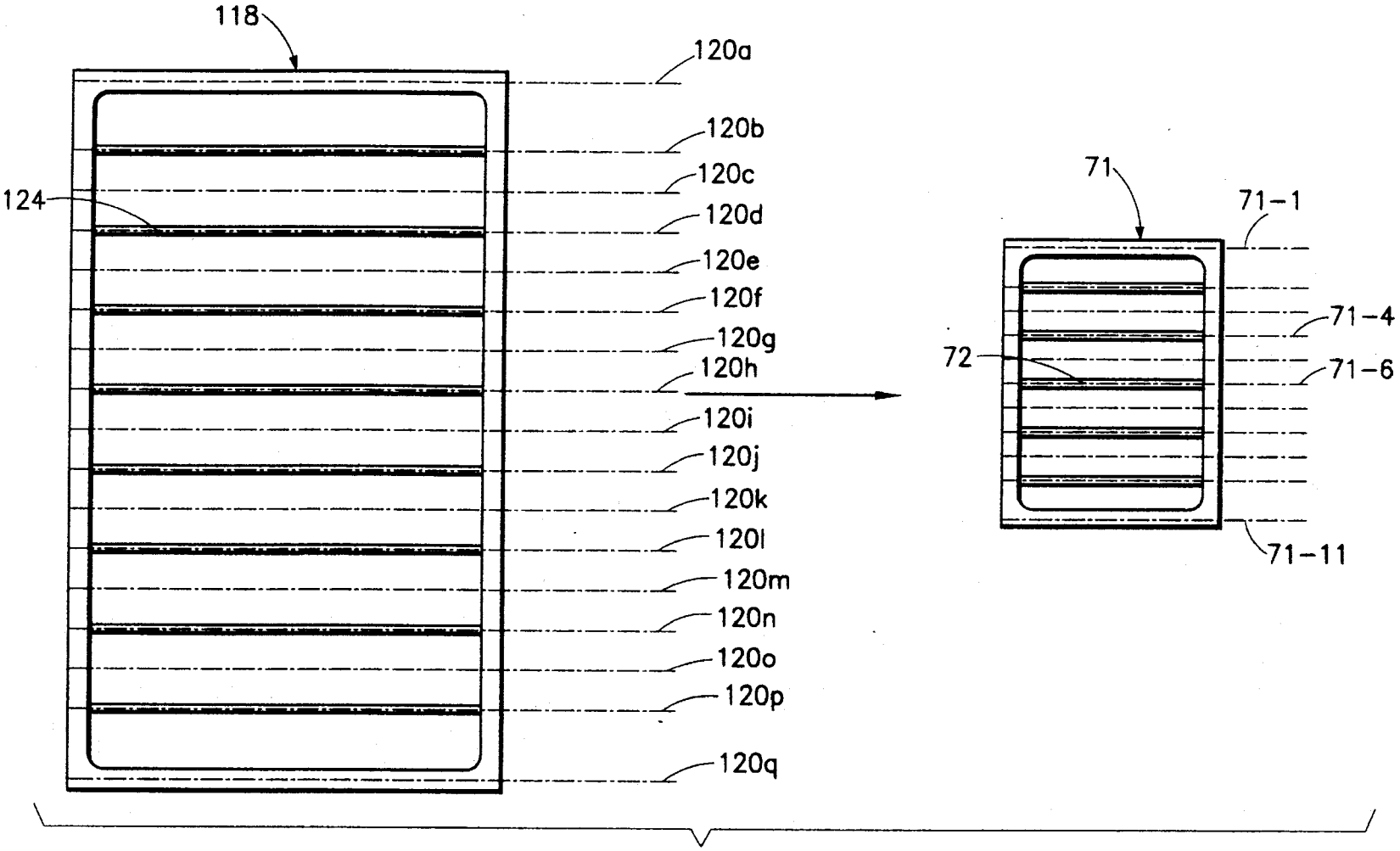
FIG. 15 diagrammatically presents the correlation between a test panel and a production panel utilizing the method of the invention.

To actually apply the method just described to the design of a tool, viewing now FIG. 15, it is first necessary to divide an actual, or production, panel 118 into a plurality of imaginary spaced parallel planes 120*a*, 120*b*, 120*c*, . . . 120*g*, in the manner described above with respect to the panel specimens (FIGS. 12A, 12B, 12C). Each imaginary plane through the production panel may correspond to a similar plane for the panel specimen 71. While the geometry of the production panel 118 must correlate to the geometry of the panel specimen 71, the actual number of planes 120*a*, etc. need not be the same in number as those of the panel specimen 71. For example, plane 120*d* in the production panel 118 is through a stiffener 124 that is similar to the stiffener 72 in plane 71-4 of the panel specimen 71; and plane 120*h* in the production panel 118 is a central stiffener 124 that is generally similar to stiffener 72 in plane 71-6 of the panel specimen 71.

Figure 16:
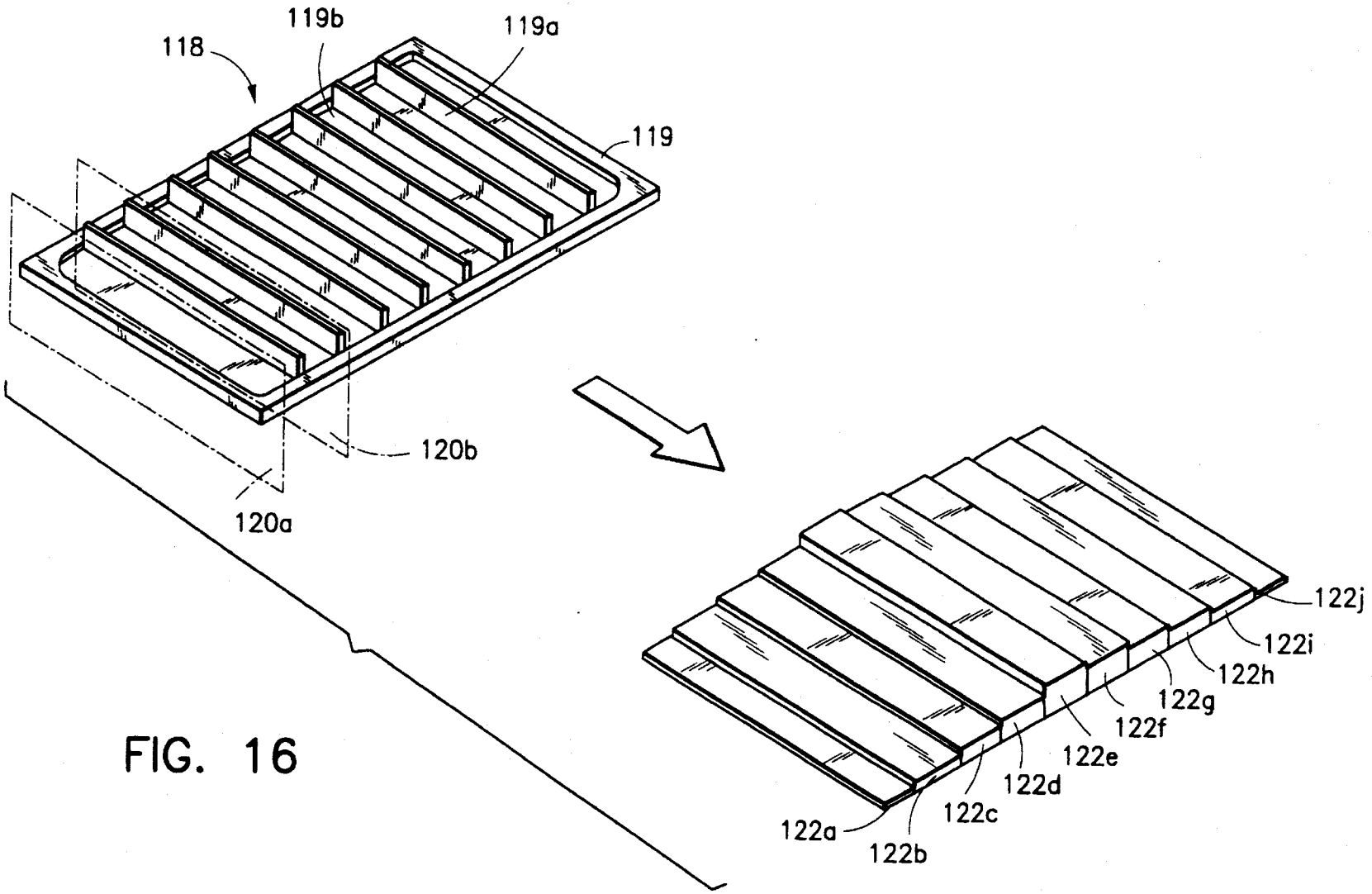
FIG. 16 is a diagrammatic representation depicting a comparison between a stiffened production panel and a simulated panel having a plurality of regions of constant thickness.

In this manner, the appropriate equations from the panel specimens 71 subjected to testing are related to the production panel 118. Since the required formed panel radius, $R_p$, is known, the equations are solved for equivalent thickness, t. In FIG. 15, the production panel 118 with integral stiffening can be represented as a series of adjacent regions of constant thickness which correlate with the planes 120*a* . . . 120*q*. FIG. 16 shows the production panel 118 with integral frames 119 and stiffeners 119*a* being represented as a series of adjacent regions 122*a* . . . 122*j* of constant thickness which correlate with the planes 122*a* . . . 122*q* (see FIG. 15). For purposes of simplicity in this disclosure, pockets 119*b*, either adjacent to the frames 119 or between the stiffeners 119*a*, are considered to be part of the region defined by each of the planes 120*a* . . . 120*q*. While the planes 120*a* . . . 120*q* lie within a constant thickness region of concern, they need not be centrally located within a region, each region thereby describing the specific panel geometry (blade, pocket, frame, and the like) that the plane is intended to define.

Now, for each region of the production panel 118, the constant thickness, t, can be used with the required panel radius to calculate a required retained strain using a relationship derived from equation (2) above:

$$\epsilon = \frac{t}{2R_p - t} \tag{7}$$

where $\epsilon$=required retained strain t=equivalent thickness $R_p$=required (formed) radius.

Each required retained strain can be used to calculate an applied strain using the strain retention or the stress relaxation equation. The former equation is shown as follows:

$$\epsilon_{Applied} = A\epsilon^2_{Retained} + B\epsilon_{Retained} + C \tag{8}$$

where A, B and C are constants.

Each applied strain can then be used to calculate a tool radius:

$$R_b = \frac{t}{2\epsilon_{Applied}} + \frac{t}{2} \tag{9}$$

where t is the equivalent thickness and $\epsilon_{Applied}$ is the applied strain.

Each plane through the panel will have a discrete tool radius, $R_b$. Tool radii are calculated in this manner for each section of the production panel 118. Tool curves comprised of several tool radii calculations can be determined for as many imaginary panel cuts as are necessary to adequately define the overall contour of a surface of an age forming tool. A smooth surface flowing from one tool curve to the next represents the desired predicted surface of the age forming tool. This general procedure for developing a smooth surface flowing from one tool curve to the next is described in detail in U.S. Pat. No. 5,168,169.

Figure 17:
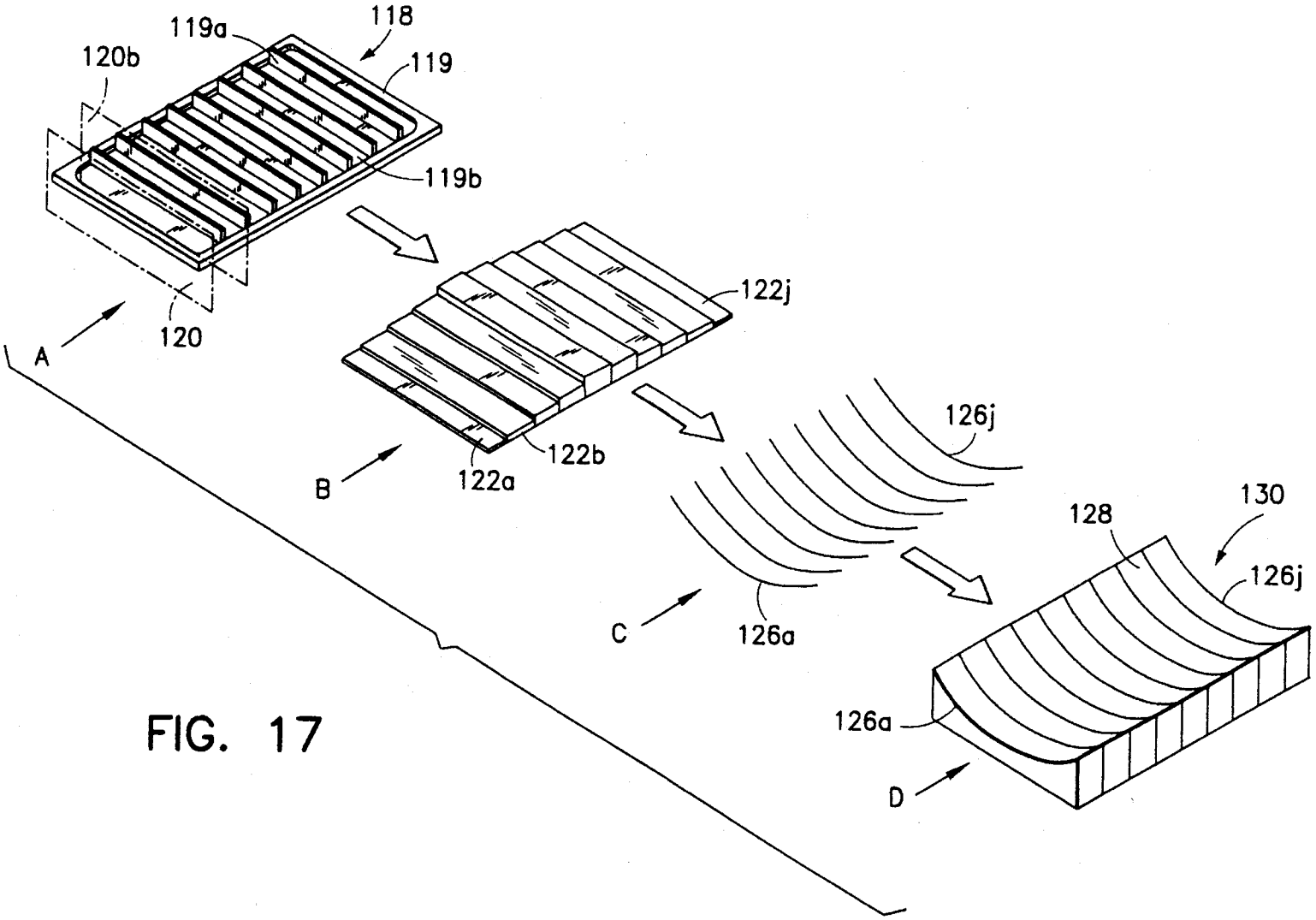
FIG. 17 is a diagrammatic representation depicting the development, according to the invention, of a tool surface for defining a stiffened panel to be formed.

An overview of the process of the invention can be seen particularly well in FIG. 17. In FIG. 17A, a production panel 118 is subjected to a plurality of imaginary planar cuts or slices 120*a* . . . 120*j* (see also FIG. 15) which are used in conjunction with the required contour and the material characteristics to define adjacent regions of a representative constant thickness (FIG. 17B). Each of these regions of constant thickness is used in conjunction with the required contour and the material characteristics to define a tool curve. A plurality of tool curves 126*a* . . . 126*j* (FIG. 17C) are developed correlating to planes 120*a* . . . 120*q* (FIG. 15), respectively. A smooth surface flowing from one curve to the next is then generated to define a finished desired surface 128 of an age forming tool 130 (FIG. 17D).

The key to utilizing the stress relaxation curve and its associated strain retention and normalized stress relaxation curves lies in the ability to calculate the applied and retained strains exhibited by test specimens subjected to age forming. One method outlined in U.S. Pat. No. 5,168,169 is based upon the relationship between the applied strain and retained strain exhibited by members of constant thickness and all of the calculations disclosed in that patent are so limited. In contrast, the present invention concerns the development of an equivalent thickness curve which equates the behavior of members of nonconstant cross section to those of members of constant cross section. However, when the attempt is made to apply the method of U.S. Pat. No. 5,168,169 to members of nonconstant cross section or having integral stiffening, the relationship between applied strain and retained strain as disclosed for constant thickness members is no longer valid. As seen from the foregoing description, new expressions for applied strain, retained strain, and their interrelationship must be developed. The complexity of these expressions increases with increased complexity of the cross section which may be in the form of stiffeners, pad-ups, ramps, pockets, and the like.

While a preferred embodiment of the invention has been disclosed in detail, it should be understood by those skilled in the art that various other modifications may be made to the illustrated embodiment without departing from the scope of the invention as described in the specification and defined in the appended claims.

What is claimed is:

1. A method of developing the surface contour of a desired tool for use in thermal forming an unformed, integrally stiffened, member of a material which exhibits stress relaxation upon exposure to an elevated temperature to produce a desired complex shaped member after exposure to the elevated temperature, said method comprising the steps of:

(a) providing a plurality of experimental forming tools having substantially different radii of curvature;

(b) thermal forming a set of specimens of the material, all of the specimens having the same integral stiffening configuration and being of uniform size, each individual specimen of a set being constrained to a different one of the experimental forming tools;

(c) cooling all of the specimens to substantially the same temperature;

(d) after step (c), releasing each of the specimens from restraint;

(e) after step (d), measuring the radius of the surface of each specimen that was in contact with the forming tool;

(f) for each specimen, producing a data set of the form (x, y) where x is the forming tool radius and y is the formed specimen radius;

(g) providing a strain retention curve for the material of the member based upon the initial and final temper conditions of the formed members, the strain retention curve being in the form of a mathematical expression;

(h) for each data set produced in step (f), substituting the tool radius x and formed member radius y into the mathematical expression provided in step (g) and developing a mathematical expression which can be solved for the thickness of an unstiffened, constant thickness, specimen that would achieve the formed radius y when thermal formed in a tool having the tool radius x;

(i) for each data set produced in step (f), plotting the thickness calculated in step (h) against the formed member radius, with the horizontal axis representing formed radius and the vertical axis representing thickness;

(j) plotting a plurality of thicknesses for the plurality of specimens;

(k) joining all of the points so plotted to form an equivalent thickness curve;

(l) expressing the equivalent thickness curve as a mathematical expression;

(m) determining from the equivalent thickness curve the thickness of a constant thickness member that yields the same formed radius as the integrally stiffened member when constrained to a forming tool of the same radius;

(n) using the constant thickness member determined in step (m) to determine the amount of strain that must be retained within the specimen after thermal forming to produce the desired complex shaped member, there being a mathematical relationship between retained strain and the radius of curvature of the desired complex shaped member;

(o) determining from the strain retention curve the value of the applied strain to be applied by the tool to the unformed member during thermal forming to achieve the value of retained strain necessary to produce the desired complex shaped member, there being a mathematical relationship between applied strain and the radius of curvature of a forming tool for forming the desired complex shaped member; and (p) knowing the applied strain, mathematically calculating the radius of curvature of the tool for forming the desired complex shaped member.

2. A method as set forth in claim 1 wherein step (b) includes the steps of:

(q) overforming each specimen in a tool having a contour of smaller curvature than the contour of a desired member;

(r) constraining the specimen in the overformed condition;

(s) applying a thermal cycle to the constrained specimen;

(t) cooling the constrained specimen following the thermal cycle;

(u) releasing the constrained specimen from the condition imparted by step (r) and allowing it to spring back to a dimensionally stable condition which defines the desired member.

3. A method as set forth in claim 2 wherein steps (q) and (r) include the steps of:

mechanically clamping the unformed member to conform to the shape of the tool; and wherein step (s) is performed in a furnace.

4. A method as set forth in claim 2 wherein steps (q) and (r) include the step of:

(v) applying pressure and/or vacuum to the unformed member to constrain it to the shape of the tool; and wherein step (s) is performed in an autoclave.

5. A method as set forth in claim 1 wherein the mathematical expression for performing step (p) is:

$$R_b = \frac{t/2}{\epsilon_{applied}} + t/2;$$

where $R_b$ represents the tool radius of curvature, where t represents the thickness of the constant thickness specimen, and where $\epsilon_{applied}$ is the applied strain.

6. A method as set forth in claim 1 including the steps, after executing step (p), of:

(w) providing a model of the desired complex shaped, integrally stiffened member;

(x) passing a plurality of imaginary spaced apart planes through the model of the desired member at spaced apart locations to thereby form a plurality of imaginary cross sectional elements;

(y) dividing each of the imaginary cross sectional elements into a plurality of imaginary segments, each having a substantially uniform stiffening configuration and a substantially uniform radius of curvature;

(z) determining from the equivalent thickness curve a constant thickness for each imaginary segment;

(a1) determining from the constant thickness determined in step (z) a retained strain from the desired radius of curvature of each imaginary segment;

(b1) determining from the strain retention curve an applied strain for the retained strain sought for each imaginary segment;

(c1) determining the tool radius for each imaginary segment obtained in step (y) from a known relationship between the applied strain determined in step (b1) and the desired tool radius;

(d1) from the tool radii calculated in step (c1), developing tool curves for each of the imaginary planes of step (x) and thereby developing a surface contour for the tool.

7. A method as set forth in claim 6 wherein the known relationship between the applied strain determined in step (b1) and the tool radius as required to perform step (c1) is:

$$R_b = \frac{t/2}{\epsilon_{applied}} + t/2; \text{ and}$$

wherein $R_b$ is the tool radius of curvature;

wherein t is the thickness of the constant thickness specimen; and wherein $\epsilon_{applied}$ is the applied strain imparted to the member by the tool.

8. A method as set forth in claim 1:

wherein there is at least one specimen for each experimental forming tool having a specific radius of curvature.

9. A method as set forth in claim 1:

wherein the mathematical expression in step (1) is a quadratic equation.

10. A method as set forth in claim 9 wherein the quadratic equation is of the form:

$$y=Ax^2+Bx+C;$$

and where A, B, and C are constants, where y is the equivalent thickness, and where x is the formed specimen radius.

11. A method as set forth in claim 1 wherein step (b) includes the application of at least one of pressure on one side and vacuum on an opposite side of each specimen.

12. A method as set forth in claim 1 wherein the mathematical expression of step (g) is a quadratic equation.

13. A method as set forth in claim 12 wherein the quadratic equation is of the form:

$$y=Ax^2+Bx+C$$

where A, B, and C are constants, where y is the strain applied to the specimen, and where x is the strain retained by the specimen.

14. A method as set forth in claim 1 wherein the mathematical expression of step (h) is a third order polynomial equation.

15. A method as set forth in claim 14 wherein the third order polynomial equation is of the form:

$$Ax^3+Bx^2+Cx+D=0;$$

and where A, B, C, and D are constants and where x is the thickness of a constant thickness cross section.

16. A method of developing the surface contour of a desired tool for use in thermal forming an unformed, integrally stiffened, member of a material which exhibits stress relaxation upon exposure to an elevated temperature to produce a desired complex shaped member after exposure to the elevated temperature, said method comprising the steps of:

(a) providing a plurality of experimental forming tools having substantially different radii of curvature;

(b) thermal forming a set of specimens of the material, all of the specimens having the same integral stiffening configuration and being of uniform size, each individual specimen of a set being constrained to a different one of the experimental forming tools;

(c) cooling all of the specimens to substantially the same temperature;

(d) after step (c), releasing each of the specimens from restraint;

(e) after step (d), measuring the radius of the surface of each specimen that was in contact with the forming tool;

(f) for each specimen, producing a data set of the form (x, y) where x is the forming tool radius and y is the formed member radius;

(g) providing a stress relaxation curve for the material of the member based upon the initial and final temper conditions of the formed members, the stress relaxation curve being in the form of a mathematical expression;

(h) for each data set produced in step (f), substituting the tool radius x and formed member radius y into the mathematical expression provided in step (g) and developing a mathematical expression which can be solved for the thickness of an unstiffened, constant thickness, specimen that would achieve the formed radius y when thermal formed in a tool having the tool radius x;

(i) for each data set produced in step (f), plotting the thickness calculated in step (h) against the formed member radius, with the horizontal axis representing formed radius and the vertical axis representing thickness;

(j) plotting a plurality of thicknesses for the plurality of specimens;

(k) joining all of the points so plotted to form an equivalent thickness curve;

(l) expressing the equivalent thickness curve as a mathematical expression;

(m) determining from the equivalent thickness curve the thickness of a constant thickness member that yields the same formed radius as the integrally stiffened member when constrained to a forming tool of the same radius;

(n) using the constant thickness member determined in step (m) to determine the amount of strain that must be retained within the specimen after thermal forming to produce the desired complex shaped member, there being a mathematical relationship between retained strain and the radius of curvature of the desired complex shaped member;

(o) determining from the stress relaxation curve the value of the applied strain to be applied by the tool to the unformed member during thermal forming to achieve the value of retained strain necessary to produce the desired complex shaped member, there being a mathematical relationship between applied strain and the radius of curvature of a forming tool for forming the desired complex shaped member; and (p) knowing the applied strain, mathematically calculating the radius of curvature of the tool for forming the desired complex shaped member.

17. A method as set forth in claim 16 wherein the mathematical expression of step (g) is a quadratic equation of the form:

$$y=Ax^2+Bx+C;$$

and where A, B, and C are constants, where y is stress experienced by a specimen and where x is the retained strain.

18. A method of developing the surface contour of a desired tool for use in cold forming an unformed, integrally stiffened, member of a material which exhibits a relationship between a strain applied by a forming operation and a resulting strain after the applied strain has been released, said method comprising the steps of:

(a) forming a set of specimens of the material, all of the specimens having the same integral stiffening configuration and being of uniform size, each individual specimen of a set being constrained to a different radius of curvature;

(b) releasing each of the specimens from restraint;

(c) after step (b), measuring the radius of the surface of each formed specimen;

(d) for each specimen, producing a data set of the form (x, y) where x is the radius of curvature to which the specimen was constrained in step (a) and y is the formed specimen radius;

(e) for the material of the specimens, providing a relationship between applied strain and retained strain, the relationship being in the form of a mathematical expression;

(f) for each data set produced in step (d), substituting the radius of curvature x and formed specimen radius y into the mathematical expression provided in step (e) and developing a mathematical expression which can be solved for the thickness of an unstiffened, constant thickness, specimen that would achieve the formed radius y when restrained to the radius of curvature x, then released from that restraint;

(g) for each data set produced in step (d), plotting the thickness calculated in step (f) against the formed member radius, with the horizontal axis representing formed radius and the vertical axis representing thickness;

(h) plotting a plurality of thicknesses for the plurality of specimens;

(i) joining all of the points so plotted to form an equivalent thickness curve;

(j) expressing the equivalent thickness curve as a mathematical expression;

(k) determining from the equivalent thickness curve the thickness of a constant thickness member that yields the same formed radius as the integrally stiffened member when constrained to a forming tool of the same radius;

(l) using the constant thickness member determined in step (k) to determine the amount of strain that must be retained within the specimen after forming to produce the desired complex shaped member, there being a mathematical relationship between retained strain and the radius of curvature of the desired complex shaped member;

(m) determining from the mathematical expression of step (e) the value of the strain to be applied to the unformed member during forming to achieve the value of retained strain necessary to produce the desired complex shaped member, there being a mathematical relationship between applied strain and the radius of curvature necessary for forming the desired complex shaped member; and (n) knowing the applied strain, mathematically calculating the radius of curvature necessary for forming the desired complex shaped member.

19. A method as set forth in claim 18 wherein a mathematical expression for performing step (n) is:

$$R=\frac{t/2}{\epsilon_{applied}}+t/2;$$

where R represents the radius of curvature to which the complex member is constrained in step (a), where t represents the thickness of the constant thickness specimen, and where $\epsilon_{applied}$ is the applied strain.

20. A method as set forth in claim 18 including the steps, after executing step (n), of:

(o) providing a model of the desired complex shaped, integrally stiffened, member;

(p) passing a plurality of imaginary spaced apart planes through the model of the desired member at spaced apart locations to thereby form a plurality of imaginary cross sectional elements;

(q) dividing each of the imaginary cross sectional elements into a plurality of imaginary segments, each having a substantially uniform stiffening configuration and a substantially uniform radius of curvature;

(r) determining from the equivalent thickness curve a constant thickness for each imaginary segment;

(s) determining from the constant thickness determined in step (r) a retained strain from the desired radius of curvature of each imaginary segment;

(t) determining from the mathematical expression of step (e) an applied strain for the retained strain sought for each imaginary segment; and (u) determining the radius of curvature necessary for forming the desired complex shaped member for each imaginary segment obtained in step (q) from a known relationship between the applied strain determined in step (t) and the constant thickness determined in step (r).

21. A method as set forth in claim 20 wherein the known relationship between the applied strain determined in step (t) and the radius of curvature as required to perform step (u) is:

$$R=\frac{t/2}{\epsilon_{applied}}+t/2;\text{ and}$$

wherein R is the radius of curvature necessary for forming the complex shaped member;

wherein t is the thickness of the constant thickness specimen; and wherein $\epsilon_{applied}$ is the applied strain imparted to the member.

22. A method as set forth in claim 18:

wherein there is at least one specimen for each radius of curvature to which the specimens of a set are constrained.

23. A method as set forth in claim 18:

wherein the mathematical expression in step (j) is a quadratic equation.

24. A method as set forth in claim 23 wherein the quadratic equation is of the form:

$$y=Ax^2+Bx+C;$$

and where A, B, and C are constants, where y is the equivalent thickness, and where x is the formed specimen radius.

25. A method as set forth in claim 18:

wherein the mathematical expression of step (e) is a quadratic equation.

26. A method as set forth in claim 25 wherein the quadratic equation is of the form:

$$y=Ax^2+Bx+C$$

where A, B, and C are constants, where y is the strain applied to the specimen, and where x is the strain retained by the specimen.

27. A method as set forth in claim 18:

wherein the mathematical expression of step (f) is a third order polynomial equation.

28. A method as set forth in claim 27 wherein the third order polynomial equation is of the form:

$$Ax^3+Bx^2+Cx+D=0;$$

and where A, B, C, and D are constants and where x is the thickness of a constant thickness cross section.

29. A method of developing the surface contour of a desired tool for use in thermal forming an unformed, integrally stiffened, member of a material which exhibits strain relaxation upon exposure to an elevated temperature to produce a desired complex shaped member after exposure to the elevated temperature, said method comprising the steps of:

(a) thermal forming at least one complex shaped stiffened member of the material in a forming tool;

(b) cooling to a lower temperature the complex shaped stiffened member;

(c) after step (b), releasing the complex shaped stiffened member from restraint;

(d) passing a plurality of imaginary spaced apart planes through the contour of the formed complex shaped stiffened member at spaced apart locations to thereby form a plurality of imaginary cross sectional elements;

(e) dividing each of the imaginary cross sectional elements into a plurality of imaginary segments, each having a substantially uniform stiffening configuration and a substantially uniform radius of curvature;

(f) after step (c), measuring the radius of the surface of the formed member at each of the imaginary segments;

(g) for each imaginary segment, producing a data set of the form (x, y) where x is the forming tool radius and y is the formed segment radius;

(h) providing a strain retention curve for the material of the complex shaped stiffened member based upon the initial and final temper conditions of the formed member, the strain retention curve being in the form of a mathematical expression;

(i) for each data set produced in step (g), substituting the tool radius x and formed member radius y into the mathematical expression provided in step (h) and developing a mathematical expression which can be solved for the thickness of an unstiffened, constant thickness, specimen that would achieve the formed radius y when thermal formed in a tool having the tool radius x;

(j) for each data set produced in step (g), plotting the thickness calculated in step (i) against the formed member radius, with the horizontal axis representing formed radius and the vertical axis representing thickness;

(k) plotting a plurality of thicknesses for the plurality of complex shaped stiffened members;

(l) joining all of the points so plotted to form an equivalent thickness curve;

(m) expressing the equivalent thickness curve as a mathematical expression;

(n) determining from the equivalent thickness curve the thickness of a constant thickness member that yields the same formed radius as the integrally stiffened member when constrained to a forming tool of the same radius;

(o) using the constant thickness member determined in step (n) to determine the amount of strain that must be retained within the specimen after thermal forming to produce the desired complex shaped member, there being a mathematical relationship between retained strain and the radius of curvature of the desired complex shaped member;

(p) determining from the strain retention curve the value of the applied strain to be applied by the tool to the unformed member during thermal forming to achieve the value of retained strain necessary to produce the desired complex shaped member, there being a mathematical relationship between applied strain and the radius of curvature of a forming tool for forming the desired complex shaped member; and (q) knowing the applied strain, mathematically calculating the radius of curvature of the tool for forming the desired complex shaped member.

* * * * *